US006164763A

United States Patent [19]

Sugama et al.

[11] Patent Number: 6,164,763

[45] Date of Patent: Dec. 26, 2000

[54] LIQUID DISCHARGING HEAD WITH A MOVABLE MEMBER OPPOSING A HEATER SURFACE

[75] Inventors: Sadayuki Sugama, Tsukuba; Akira Asai, Atsugi; Hiroyuki Ishinaga, Tokyo; Toshio Kashino, Chigasaki; Aya Yoshihira; Kiyomitsu Kudo, both of Yokohama; Yoshie Asakawa, Nagano-ken; Hiroyuki Sugiyama, Sagamihara, all of Japan

[73] Assignee: Canon Kabushiki Kaisha, Tokyo, Japan

[21] Appl. No.: 08/888,509

[22] Filed: Jul. 7, 1997

[30] Foreign Application Priority Data

| | | | |
|---|---|---|---|
| Jul. 5, 1996 | [JP] | Japan | 8-176660 |
| Jul. 12, 1996 | [JP] | Japan | 8-183575 |
| Jul. 4, 1997 | [JP] | Japan | 9-179474 |

[51] Int. Cl.[7] ..... B41J 2/05

[52] U.S. Cl. ..... 347/63; 347/63

[58] Field of Search ..... 347/65, 63

[56] References Cited

U.S. PATENT DOCUMENTS

| | | | |
|---|---|---|---|
| 4,480,259 | 10/1984 | Kruger et al. . | |
| 4,496,960 | 1/1985 | Fischbeck . | |
| 4,509,063 | 4/1985 | Sugitani et al. . | |
| 4,558,333 | 12/1985 | Sugitani et al. . | |
| 4,568,953 | 2/1986 | Aoki et al. . | |
| 4,587,534 | 5/1986 | Saito | 347/63 |
| 4,611,219 | 9/1986 | Sugitani et al. . | |
| 4,698,645 | 10/1987 | Inamoto . | |
| 4,723,129 | 2/1988 | Endo et al. . | |
| 4,723,136 | 2/1988 | Suzumura . | |
| 4,994,825 | 2/1991 | Saito et al. . | |
| 5,175,565 | 12/1992 | Ishinaga et al. . | |
| 5,208,604 | 5/1993 | Watanabe et al. . | |
| 5,262,802 | 11/1993 | Karita et al. . | |
| 5,270,730 | 12/1993 | Yaegashi | 347/56 |
| 5,278,585 | 1/1994 | Karz et al. | 347/65 |
| 5,296,875 | 3/1994 | Suda . | |
| 5,389,957 | 2/1995 | Kimura et al. . | |
| 5,485,184 | 1/1996 | Nakagomi et al. . | |
| 5,589,858 | 12/1996 | Kadowaki et al. . | |
| 5,602,576 | 2/1997 | Murooka et al. . | |
| 5,708,466 | 1/1998 | Noguchi | 347/65 |
| 5,821,962 | 10/1998 | Kudo | 347/65 |
| 5,838,351 | 11/1998 | Weber | 347/85 |
| 5,872,582 | 2/1999 | Pan | 347/65 |

FOREIGN PATENT DOCUMENTS

| | | | |
|---|---|---|---|
| 0 739 734 | 10/1966 | European Pat. Off. | B41J 2/045 |
| 0436047 | 7/1991 | European Pat. Off. . | |
| 0443798 | 8/1991 | European Pat. Off. . | |
| 0496533 | 7/1992 | European Pat. Off. . | |
| 0538147 | 4/1993 | European Pat. Off. . | |
| 0 739 734 | 10/1996 | European Pat. Off. | B41J 2/045 |
| 0 813 967 | 12/1997 | European Pat. Off. | B41J 2/14 |
| 61-59914 | 2/1980 | Japan . | |
| 55-81172 | 6/1980 | Japan . | |
| 61-69467 | 4/1986 | Japan . | |
| 61-110557 | 5/1986 | Japan . | |

(List continued on next page.)

*Primary Examiner*—Richard Moses
*Attorney, Agent, or Firm*—Fitzpatrick, Cella, Harper & Scinto

[57] ABSTRACT

A liquid discharging method of regulating and directing an air bubble to a discharge port by a substrate having a heat generating surface for generating heat for creating an air bubble in a liquid disposed in face-to-face relationship with a liquid discharge port, a movable member provided so as to intervene between the heat generating surface and the discharge port, and having a free end displaceable by the air bubble, the free end or a changing portion being located in an area opposed to the minimum area region of the discharge port or upstream of the opposed area, and an opposed surface opposed to a surface which provides the heat generating surface side of the movable member when the free end of the movable member is displaced by the air bubble, and fixed to cooperate with the movable member during the displacement of the movable member to direct the air bubble toward the discharge port.

7 Claims, 14 Drawing Sheets

FOREIGN PATENT DOCUMENTS

| | | | |
|---|---|---|---|
| 62-156969 | 7/1987 | Japan | B41J 3/04 |
| 62-48585 | 10/1987 | Japan . | |
| 63-197652 | 8/1988 | Japan . | |
| 63-199972 | 8/1988 | Japan . | |
| 2-113950 | 4/1990 | Japan . | |
| 3-81155 | 4/1991 | Japan . | |
| 5-124189 | 5/1993 | Japan | B41J 2/95 |
| 6-31918 | 2/1994 | Japan | B41J 2/05 |
| 6-87214 | 3/1994 | Japan . | |
| 2 306 399 | 5/1997 | United Kingdom | B41J 2/175 |

LIQUID DISCHARGING HEAD WITH A MOVABLE MEMBER OPPOSING A HEATER SURFACE

BACKGROUND OF THE INVENTION

1. Field of the Invention

This invention relates to a recording method and a recording apparatus using the step of communicating an air bubble formed by the utilization of heat energy with the atmosphere, and particularly to a liquid discharging head having a movable member displaceable by the utilization of the creation of an air bubble, a head cartridge using the liquid discharging head, and a liquid discharging device.

This invention can be applied to an apparatus such as a printer for effecting recording on paper, yarn, fiber, cloth, leather, metals, plastics, glass, wood, ceramics or the like as a recording medium, a copying apparatus, a facsimile apparatus having a transmitting system or a word processor having a printer portion, or further an industrial recording apparatus compositely combined with various processing apparatuses.

The term "recording" in the present invention means not only imparting an image having a meaning such as characters or figures to a recording medium, but also imparting an image having no meaning such as a pattern to the recording medium.

2. Related Backgound Art

There is known an ink jet recording method, i.e., a so-called bubble jet recording method, of imparting energy such as heat to ink to thereby create a state change accompanied by a step volume change (creation of an air bubble) in the ink, discharging the ink from a discharge port by an acting force based on this state change, and causing the ink to adhere onto a recording medium to thereby effect image formation. In a recording apparatus using this bubble jet recording method, as disclosed in U.S. Pat. No. 4,723,129, etc., there are generally disposed a discharge port for discharging the ink, an ink flow path communicating with this discharge port, and an electro-thermal converting member as energy generating means for discharging the ink disposed in the ink flow path.

According to such a recording method, images of high quality can be recorded at a high speed and with low noise, and in the head carrying out this recording method, discharge ports for discharging the ink can be disposed at high density and therefore, there are many excellent advantages including the advantage that recorded images of a high degree of resolution, and further color images can be easily obtained by a compact apparatus. Therefore, this bubble jet recording method has recently been utilized in many office instruments such as printers, copying apparatuses and facsimile apparatuses and further, even in industrial systems such as textile printing apparatuses.

As the bubble jet technique is utilized in many fields of products, the following requirements have further heightened in recent years.

For example, as the study on the requirement of an improvement in energy efficiency, mention is made of the optimization of a heat generating member such as adjusting the thickness of protective film. This technique is effective in improving the efficiency of propagation of generated heat to liquid.

Also, there has been proposed a driving condition for providing a liquid discharging method or the like which is high in ink discharge speed and which can effect good ink discharge based on the stable creation of an air bubble, and there has also been proposed an apparatus in which from the viewpoint of high-speed recording, the shape of a flow path is improved to obtain a liquid discharge head which is high in the refill speed of discharged liquid into a liquid flow path.

Of this shape of the flow path, what is shown as flow path structure in FIGS. 18A and 18B of the accompanying drawings is described in Japanese Laid-Open Patent Application No. 63-199972, etc. The flow path structure and head manufacturing method described in this publication are inventions having paid attention to a back wave created with the creation of an air bubble (pressure travelling in a direction opposite to the direction toward a discharge port, i.e., pressure travelling toward a liquid chamber 1012). This back wave, which is not energy travelling in the discharge direction, is known as loss energy.

The invention shown in FIGS. 18A and 18B discloses a valve 1010 spaced apart from an area in which an air bubble is formed by a heat generating element 1002 and located on the opposite side from a discharge port 1011 with respect to a heat generating element 1002.

In FIG. 18B, this valve 1010 is disclosed as one having an initial position like sticking on the ceiling of a flow path 1003 by a manufacturing method utilizing a plate material or the like, and hanging into the flow path 1003 with the creation of an air bubble. This invention is disclosed as one which controls a part of the above-described back wave by the valve 1010 to thereby suppress energy loss.

In this construction, however, as can be seen from the study of the time when an air bubble is created in the flow path 3 holding the liquid to be discharged, it is seen that it is not practical to liquid discharge to suppress a part of the back wave by the valve 10.

Originally the back wave itself is not directly concerned in discharge as previously described. At a point of time whereat this back wave has been created in the flow path 3, as shown in FIG. 18A, the pressure of the air bubble which is directly concerned in discharge already makes the liquid dischargeable from the flow path 3. Accordingly, it is apparent that even if a part of the back wave is suppressed, it will not greatly affect discharge.

On the other hand, in the bubble jet recording method, heating is repeated with a heat generating member being in contact with ink and therefore, a deposit due to the scorching of the ink is created on the surface of the heat generating member. However, this deposit is much created depending on the kind of the ink. When this is created, the discharge of the ink becomes unstable. In addition, in the case of a liquid in which the liquid to be discharged is liable to be deteriorated by heat or a liquid of which the bubbling is difficult to obtain sufficiently, there has been desired a liquid which is not changed in quality but is discharged well.

A method of making a liquid creating an air bubble by heat (bubbling liquid) and a liquid to be discharged (discharge liquid) discrete from each other, and transmitting the pressure by bubbling to the discharge liquid to thereby discharge the discharge liquid is disclosed in publications such as Japanese Laid-Open Patent Application No. 61-69467, Japanese Laid-Open Patent Application No. 55-81172 and U.S. Pat. No. 4,480,259. These publications adopt a construction in which ink which is the discharge liquid and the bubbling liquid are completely separated from each other by flexible film such as silicone rubber so that the discharge liquid may not directly contact with a heat generating member, and the pressure by the bubbling of the bubbling liquid is transmitted to the discharge liquid by the deformation of the flexible film. By such a construction, the prevention of a deposit on the surface of the heat generating member, an improvement in the degree of freedom of selection of the discharge liquid, etc. are achieved.

However, in the head wherein the discharge liquid and the bubbling liquid are completely separated from each other as previously described, the pressure during bubbling is transmitted to the discharge liquid by the expansion and contraction of the flexible film and therefore, the flexible film considerably absorbs the pressure by bubbling. Also, the amount of deformation of the flexible film is not very great and therefore, the effect by separating the discharge liquid and the bubbling liquid from each other can be obtained, but the energy efficiency and the discharging force are reduced.

SUMMARY OF THE INVENTION

The present invention has as its primary task to heighten the discharge characteristic of liquid in a system wherein an air bubble (particularly an air bubble resulting from film boiling) is formed in a liquid flow path to thereby discharge the liquid to a level which could not heretofore be anticipated, from a viewpoint which could not heretofore be considered. We have returned to the principle of liquid droplet discharge and have energetically carried out studies to provide a novel liquid droplet discharging method utilizing an air bubble which could not heretofore be obtained and a liquid discharging head, etc. using the same. As a result, a movable member having a free end is interposed between the heat generating surface of a heat generating member and a discharge port and has a direct communication area in which the heat generating surface and the discharge port directly communicate with each other, whereby an entirely novel technique for effectively controlling the air bubble is established and the present invention has come to be made.

We have previously returned to the principle of liquid droplet discharge and have proposed an invention which can provide a novel liquid discharging method utilizing an air bubble which could not heretofore be obtained by the use of a movable member, and a liquid discharging head using the same.

What we have particularly paid our attention to in the present invention with the above-described invention taken into account is to consider the movable member and the discharge port and the construction of the heat generating member, and we have come to derive an epoch-making invention for causing the previously proposed discharging method to act more effectively, and stabilizing the discharging force by a simple construction and heightening the discharge efficiency.

It is an object of the present invention to provide a liquid discharging method and a head which effectively controls an air bubble and has achieved a stable discharging force and an improvement in discharge efficiency.

It is a second object of the present invention to provide, in addition to achieving the above object, a liquid discharging method and a head which are simple in construction and good in the yield of manufacture.

It is another object of the present invention to provide a liquid discharging method, a liquid discharging head, etc. which are improved in the discharge efficiency, the discharging force, the discharging speed and the accuracy of shooting of liquid onto a recording medium.

It is still another object of the present invention to provide a liquid discharging method, a liquid discharging head, etc. which can suppress the working of an inertia force in a direction opposite to the liquid supply direction by a back wave and reduce the amount of retreat of meniscus by the valve function of a movable member to thereby heighten the refilling frequency and improve the printing speed.

It is yet still another object of the present invention to provide a liquid discharging method, a liquid discharging head, etc. which mitigates the heat accumulation onto liquid on a heat generating member and reduces air bubbles remaining on the heat generating member and can thereby effect the good discharge of the liquid stably.

It is a further object of the present invention to provide a liquid discharging method, a liquid discharging head, etc. which can reduce deposits on a heat generating member and widen the range of use and the degree of freedom of selection of discharge liquid and moreover is sufficiently high in the discharge efficiency and the discharging force.

It is still a further object of the present invention to provide a head cartridge and a liquid discharging device provided with the liquid discharging head as described above.

It is yet still a further object of the present invention to provide a liquid discharging head kit for facilitating the reutilization of the liquid discharging head of the present invention.

The liquid discharging method of the present invention is characterized by regulating and directing an air bubble to a discharge port by a substrate having a heat generating surface for generating heat for creating an air bubble in a liquid disposed in face-to-face relationship with a liquid discharge port, a movable member provided so as to intervene between the heat generating surface and the discharge port, and having a free end displaceable by the air bubble, the free end or a changing portion being located in an area opposed to the minimum area region of the discharge port or upstream of the opposed area, and an opposed surface opposed to a surface which provides the heat generating surface side of the movable member when the free end of the movable member is displaced by the air bubble, and fixed to cooperate with the movable member during the displacement of the movable member to direct the air bubble toward the discharge port.

In this case, the air bubble formed in the liquid may be grown and communicated with the atmosphere in the discharge port area to thereby discharge the liquid, and further, in order to discharge the air bubble in the liquid after the air bubble has communicated with the atmosphere into the atmosphere, such a degree of air bubble that discharge is not effected may be created to thereby displace the movable member.

The liquid discharging head of the present invention has:

a substrate having a heat generating surface for generating heat for creating an air bubble in a liquid disposed in face-to-face relationship with a liquid discharge port;

a movable member provided so as to intervene between the heat generating surface and the discharge port, and having a free end displaceable by the air bubble; and an opposed surface opposed to a surface which provides the heat generating surface side of the movable member when the free end of the movable member is displaced by the air bubble, and fixed to cooperate with the movable member during the displacement of the movable member to direct the air bubble toward the discharge port;

the center of the heat generating surface relative to a perpendicular passing through the discharge port and perpendicular to the discharge port and the free end or the changing portion of the movable member being disposed upstream with respect to the flow of the liquid toward the discharge port.

Also, the liquid discharging head of the present invention has:

a substrate having a heat generating surface for generating heat for creating an air bubble in a liquid disposed in face-to-face relationship with a liquid discharge port;

a movable member provided so as to intervene between the heat generating surface and the discharge port, and having a free end displaceable by the air bubble; and an opposed surface opposed to a surface which provides the heat generating surface side of the movable member when the free end of the movable member is displaced by the air bubble, and fixed to cooperate with the movable member during the displacement of the movable member to direct the air bubble toward the discharge port;

the center of the heat generating surface relative to a perpendicular passing through the discharge port and perpendicular to the discharge port and the free end or the changing portion of the movable member being disposed upstream with respect to the flow of the liquid toward the discharge port;

the free end of the movable member being located outside the projection area of the discharge port onto the substrate when the movable member reaches its maximum displacement by the air bubble.

Also, the liquid discharging head of the present invention is a liquid discharging head for growing an air bubble formed in a liquid and communicating it with the atmosphere in a discharge port area to thereby discharge the liquid, having:

a substrate having a heat generating surface for generating heat for creating an air bubble in the liquid disposed in face-to-face relationship with a liquid discharge port;

a movable member provided so as to intervene between the heat generating surface and the discharge port, and having a free end displaceable by the air bubble; and an opposed surface opposed to a surface which provides the heat generating surface side of the movable member when the free end of the movable member is displaced by the air bubble, and fixed to cooperate with the movable member during the displacement of the movable member to direct the air bubble toward the discharge port;

the center of the heat generating surface relative to a perpendicular passing through the discharge port and perpendicular to the discharge port and the free end or the changing portion of the movable member being disposed upstream with respect to the flow of the liquid toward the discharge port.

The above-mentioned opposed surface may be a barrier.

Also, the surface of at least a portion of the barrier may be formed so as to reduce the cross-sectional area of a flow path leading toward the discharge port.

Also, the liquid discharging head of the present invention is a liquid discharging head for growing an air bubble formed in a liquid and communicating it with the atmosphere in a discharge port area to thereby discharge the liquid, having:

a substrate having a heat generating surface for generating heat for creating an air bubble in the liquid disposed in face-to-face relationship with a liquid discharge port;

a movable member provided so as to intervene between the heat generating surface and the discharge port, and having a free end displaceable by the air bubble; and an opposed surface opposed to a surface which provides the heat generating surface side of the movable member when the free end of the movable member is displaced by the air bubble, and fixed to cooperate with the movable member during the displacement of the movable member to direct the air bubble toward the discharge port;

the center of the heat generating surface relative to a perpendicular passing through the discharge port and perpendicular to the discharge port and the free end or the changing portion of the movable member being disposed upstream with respect to the flow of the liquid toward the discharge port;

the free end of the movable member being located outside the projection area of the discharge port onto the surface of the substrate when the movable member reaches its maximum displacement by the air bubble.

(Action)

In the present invention, the movable member for regulating the direction of growth of the air bubble intervening between the heat generating surface of the heat generating member and the discharge port is displaced toward the discharge port by the pressure of the air bubble created on the heat generating surface.

As a result, the movable member can cooperate with the opposed member opposed to the movable member to turn the direction of growth of the air bubble toward the discharge port just in such a manner to throttle the communication path between the heat generating surface and the discharge port, and concentrates the pressure of the air bubble toward the discharge port.

Therefore, the liquid can be discharged at high discharge efficiency and with a high discharge force and further, with high accuracy of shooting onto a recording medium.

Also, the influence of the back wave can be reduced by the movable member and further, the direction in which the movable member after discharge has been done is displaced to its initial state is the direction of refilling of the liquid. Accordingly, there can be obtained high responsiveness during continuous liquid discharge, stable growth of the air bubble and stable discharge characteristic of liquid droplets, and there can be achieved high-speed recording and high quality recording by high-speed liquid discharge.

The terms "upstream" and "downstream" used in the description of the present invention are expressions with respect to the direction of flow of the liquid toward the discharge port or with respect to the direction in this construction, via a liquid supply source to an air bubble creating area (or the movable member).

Also, the "downstream side" with respect to the air bubble itself represents chiefly the discharge port side portion of the air bubble regarded as directly acting on the discharge of liquid droplets More specifically, it means the downstream side relative to the center of the air bubble with respect to the above-mentioned direction of flow or the above-mentioned direction in the construction, or the air bubble created in the area downstream of the center of the area of the heat generating member.

Further, the "separating wall" referred to in the present invention means, in its broad sense, a wall (which may include the movable member) intervening so as to divide into an air bubble creating area and an area directly communicating with the discharge port, and, in its narrow sense, means that which divides into a flow path including an air bubble creating area and a liquid flow path directly communicating with the discharge port, and prevents the mixing of liquids in the respective areas.

A liquid discharging method and a liquid discharging head according to another form of the present invention are characterized by a direct communication area in which the heat generating surface and the discharge port directly communicate with each other, and specifically are constructed as follows.

A liquid discharging method according to another form of the present invention is characterized by regulating and directing an air bubble to a discharge port by:

a substrate having a heat generating surface for generating heat for creating an air bubble in a liquid disposed in face-to-face relationship with a liquid discharge port;

a movable member having a direct communication area in which the heat generating surface and the discharge port directly communicate with each other, and opposed to the heat generating surface and provided so as to intervene between the heat generating surface and the discharge port, and having a free end displaceable by the air bubble; and an opposed surface opposed to a surface which provides the heat generating surface side of the movable member when the free end of the movable member is displaced by the air bubble, and fixed to cooperate with the movable member during the displacement of the movable member to direct the air bubble toward the discharge port.

Also, the liquid discharging method is characterized by regulating and directing an air bubble to a discharge port by:

a substrate having a heat generating surface for generating heat for creating an air bubble in a liquid disposed in face-to-face relationship with a liquid discharge port;

a movable member having a direct communication area in which the heat generating surface and the discharge port directly communicate with each other, and opposed to the heat generating surface and provided so as to intervene between the heat generating surface and the discharge port, and having a free end displaceable by the air bubble, the free end being located in an area opposed to the central area of the discharge port or upstream of the opposed area; and an opposed surface opposed to a surface which provides the heat generating surface side of the movable member when the free end of the movable member is displaced by the air bubble, and fixed to cooperate with the movable member during the displacement of the movable member to direct the air bubble toward the discharge port.

Also, the liquid discharging method is characterized by:

a substrate having a heat generating surface for generating heat for creating an air bubble in a liquid disposed in face-to-face relationship with a liquid discharge port; and a movable member having a direct communication area in which the heat generating surface and the discharge port directly communicate with each other, and opposed to the heat generating surface and provided so as to intervene between the heat generating surface and the discharge port, and having a free end displaceable by the air bubble;

a plurality of the movable members opposed to each other with the direct communication area interposed therebetween cooperating with each other to direct the air bubble toward the discharge port when the free ends of the movable members are displaced by the air bubble.

In one of the above-described liquid discharging methods, the width of the direct communication area is greater than 5 $\mu$m and smaller than the diameter of the discharge port.

Also, a liquid discharging method wherein provision is made of a direct communication area in which a liquid discharge port directly communicates with an effective air bubble creating area for generating heat for creating an air bubble in a liquid disposed in face-to-face relationship with the discharge port, and an intervenient area between the effective air bubble creating area and the discharge port in which the free end of a movable member displaceable by the air bubble is opposed to the minimum inner diameter of the discharge port, the areas being adjacent to each other, and the air bubble is regulated and directed to the discharge port with the displacement of the movable member to thereby effect the discharge of the liquid, is characterized in that the discharge is effected with the length of the effective air bubble creating area opposed to the direct communication area being equal to or greater than 5 $\mu$m, or the length of the direct communication area along the effective air bubble creating area being equal to or greater than 5 $\mu$.

Also, a liquid discharging method wherein provision is made of a direct communication area in which a liquid discharge port directly communicates with an effective air bubble creating area for generating heat for creating an air bubble in a liquid disposed in face-to-face relationship with the discharge port, and an intervenient area between the effective air bubble creating area and the discharge port in which the free end of a movable member displaceable by the air bubble is opposed to the minimum inner diameter of the discharge port, the areas being adjacent to each other, and the air bubble is regulated and directed to the discharge port with the displacement of the movable member to thereby effect the discharge of the liquid, is characterized in that the discharge is effected under a condition under which the effective air bubble creating area and the central portion of the discharge port are directly opposed to each other.

A liquid discharging head according to another form of the present invention is characterized by the provision of:

a substrate having a heat generating surface for generating heat for creating an air bubble in a liquid disposed in face-to-face relationship with a liquid discharge port;

a direct communication area in which the heat generating surface and the discharge port directly communicate with each other;

a movable member opposed to the heat generating surface and provided so as to intervene between the heat generating surface and the discharge port, and having a free end displaceable by the air bubble; and an opposed surface opposed to a surface which provides the heat generating surface side of the movable member when the free end of the movable member is displaced by the air bubble, and fixed to cooperate with the movable member during the displacement of the movable member to direct the air bubble toward the discharge port.

Also, the liquid discharging head is characterized by the provision of:

a substrate having a heat generating surface for generating heat for creating an air bubble in a liquid disposed in face-to-face relationship with a liquid discharge port;

a direct communication area in which the heat generating surface and the discharge port directly communicate with each other;

a movable member opposed to the heat generating surface and provided so as to intervene between the heat generating surface and the discharge port, and having a free end displaceable by the air bubble, the free end being located in an area opposed to the central area of the discharge port or upstream of the opposed area; and an opposed surface opposed to a surface which provides the heat generating surface side of the movable member when the free end of the movable member is displaced by the air bubble, and fixed to cooperate with the movable member during the displacement of the movable member to direct the air bubble toward the discharge port.

The liquid discharging head is characterized by:

a substrate having a heat generating surface for generating heat for creating an air bubble in a liquid disposed in face-to-face relationship with a liquid discharge port;

a direct communication area in which the heat generating surface and the discharge port directly communicate with each other; and a plurality of movable members opposed to the heat generating surface and provided so as to intervene between the heat generating surface and the discharge port, and having free ends displaceable by the air bubble, and cooperating with each other when each of the free ends is displaced by the air bubble to direct the air bubble toward the discharge port.

In one of the above-described liquid discharging heads, the width of the direct communication area is greater than 5 μm and smaller than the diameter of the discharge port.

(Action When the Direct Communication Area Is Provided)

The "direct communication area or communication area between the discharge port and the heat generating surface" referred to in the present invention means an area in which the discharge port and the heat generating surface for creating an air bubble are directly opposed to each other without anything but liquid intervening therebetween, and by this area, the propagation of the pressure wave of an air bubble created by the heat generating surface and the grown component of the air bubble itself can directly travel toward the discharge port. Particularly in this direct communication area, the pressure wave and the grown component of the air bubble are preferentially directed to the discharge port and therefore, the free end of the movable member can be displaced while the pressure wave is directly caused to pass and is more effectively directed to the discharge port. In this sense, a communication space having a width of 5 μm or greater may preferably be provided as this direct communication area.

Further, the heat generating surface referred to in the present invention includes the meaning as the effective air bubble creating area of the heat generating surface.

According to the present invention, under the premise condition that the free end is located more adjacent to the discharge port side than the fulcrum of the movable member, it can be utilized for the formation of environment in which the free end is readily movable, in contrast with the formation of a pressure gradient which brings about the direct movement of the free end that the portion of the air bubble created from the effective air bubble creating area which is directly directed to the discharge port is the forward portion downstream of the center of the effective air bubble creating area with respect to the direction from the fulcrum to the free end, and the discharge efficiency can be synthetically improved. That is, a sound wave (a compressional wave) brought about when the air bubble is created from the effective air bubble creating area is directly propagated through the liquid and early and reliably forms a pressure gradient (distribution) in the liquid in the displacement area, relative to the displacement area (liquid flow path) of the movable member. As a result, of the liquid located at the free end of the movable member and in the direction of movement of the surface of the movable member near the free end, the quantity to be moved to the discharge port can be increased.

Also, according to the present invention, in the displacement area, a dividing area in which the flow of the liquid is dispersed to the discharge port side and the fulcrum side can be shifted to the fulcrum side of the surface area of the movable member and therefore, the quantity of discharged liquid can be more stabilized, and the discharge efficiency can be improved and the refilling action during refill can be effected rationally and the refilling time can be shortened.

The head cartridge of the present invention is a head cartridge having the liquid discharging head constructed as described above, and a liquid container holding therein the liquid to be supplied to the liquid discharging head.

The recording apparatus of the present invention has the liquid discharging head constructed as described above, and driving signal supply means for supplying a driving signal for discharging the liquid from the liquid discharging head.

Also, the recording apparatus of the present invention has the liquid discharging head constructed as described above, and recording medium conveying means for conveying a recording medium receiving the liquid discharged from the liquid discharging head.

DESCRIPTION OF THE PREFERRED EMBODIMENTS

Some embodiments of the present invention will hereinafter be described with reference to the drawings.

[Embodiment 1]

Figure 1:
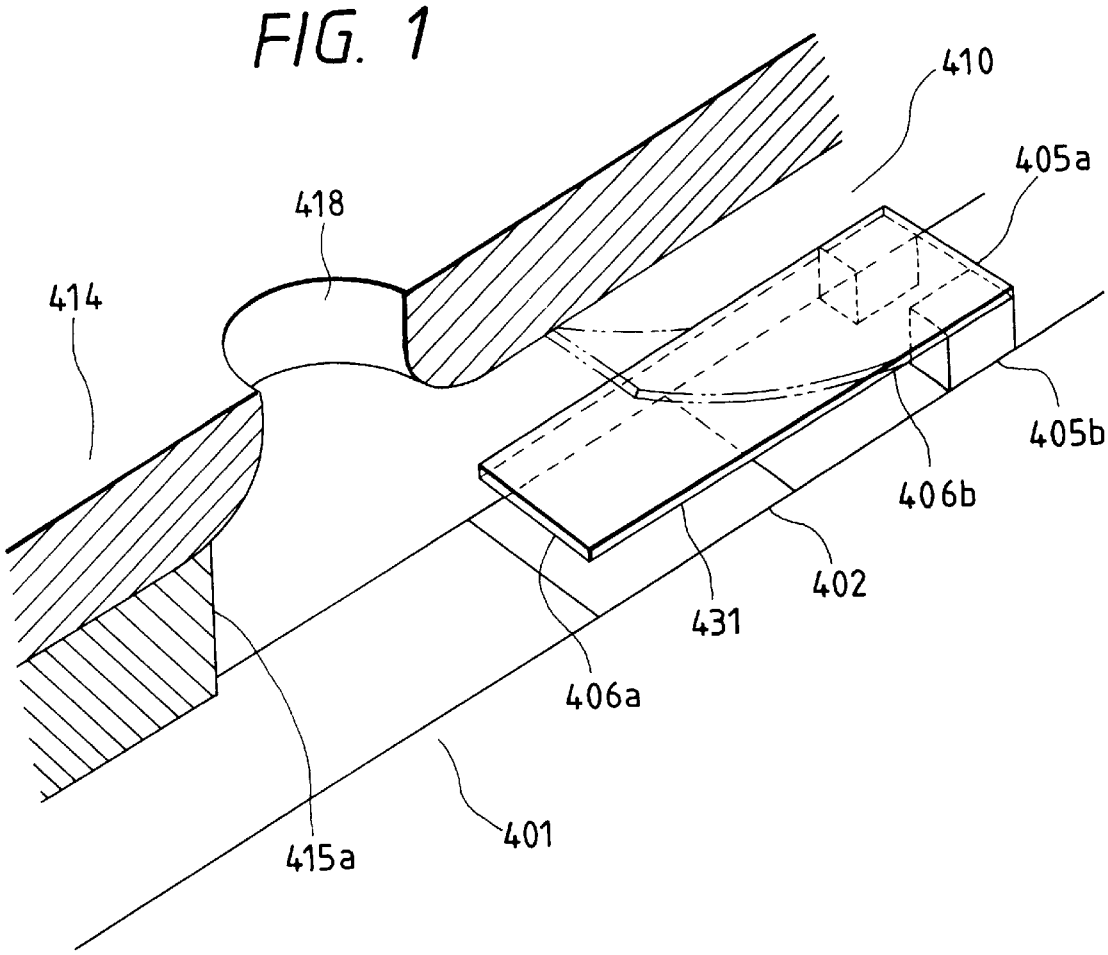
FIG. 1 is a fragmentary broken-away perspective view of the discharge nozzle portion of an embodiment of a liquid discharging head according to the present invention.

FIG. 1 is a schematic fragmentary broken-away perspective view showing the construction of a first embodiment of the liquid discharging head of the present invention including a supporting portion for supporting a movable member.

The liquid discharging head of this embodiment is a head of the so-called side shooter type in which a discharge port 418 is disposed so as to face substantially in parallelism to the heat generating surface of a heat generating member 402. The heat generating member 402 (in the present embodiment, a heat generating resistance member of 48 μm×46 μm) is provided on a substrate 401, and generates heat energy utilized to cause film boiling as described in U.S. Pat. No. 4,723,127 in a liquid and create an air bubble. The discharge port 418 is provided in an orifice plate 414 which is a discharge port member. This orifice plate 414 is formed by electrocasting nickel.

A liquid flow path 410 for letting the liquid flow therethrough is provided between the orifice plate 414 and the substrate 401 so as to directly communicate with the discharge port 418. In the present embodiment, ink of water line is used as the liquid to be discharged.

A movable member 431 in the form of a flat plate cantilever beam is provided in the liquid flow path 410 in opposed relationship with the heat generating member 402. The movable member 431 is located near the upward projection space of the heat generating surface of the heat generating member 402 in a direction perpendicular to the heat generating surface, and the heat generating member 402 and the end portion 406*a* of the movable member 431 are disposed so as to be outside the projection area of the discharge port 418. The movable member 431 is formed of a resilient material such as a metal. In the present embodiment, it is formed of nickel having a thickness of 5 μm. One end 405*a* of the movable member 431 is fixed to and supported by a supporting member 405*b*. The supporting member 405*b* is formed by patterning photosensitive resin on the substrate 401. The movable member 431 and the heat generating surface of the heat generating member 402 are disposed at an interval of the order of 15 μm.

Designated by the reference character 415*a* is a wall member as an opposed member which is opposed to a surface which provides the heat generating surface side of the movable member 431 when the movable member 431 is liberated. The movable member 431 has a fixed end (a fulcrum) 406*b* on the upstream side of the flow of the liquid flowing from a common liquid chamber (not shown) to the discharge port 418 through a supply path (not shown) and via the movable member 431, and a free end 406*a* on the downstream side of the flow of the liquid. The fixed end 406*b* works as a base portion which provides a fulcrum when the movable member 431 is liberated.

At least the free end 406*a* of the movable member 431 is disposed in an area which the pressure by an air bubble reaches.

In the ensuing description, the area on the upper side (the discharge port side) of the movable member 431 in its steady state is defined as "A" and the area on the lower side (the heat generating member side) is defined as "B".

When heat is generated from the heat generating surface of the heat generating member 402 and an air bubble is created in the area B, the free end 406*a* of the movable member 431 is moved in a moment in the direction of dots-and-dash line in FIG. 1 toward the area A side with the base portion 406*b* as a fulcrum by pressure resulting from the creation and growth of the air bubble or the growing air bubble itself, and the liquid is discharged from the discharge port 418.

In the present embodiment, the movable member 431 is disposed so that the free end 406*a* thereof may be upstream of substantially the center of the discharge port 418.

The application of an electrical signal to the heat generating member 402 which is an electro-thermal converting member is effected by a wiring electrode (not shown) disposed on the substrate 401.

Figure 2:
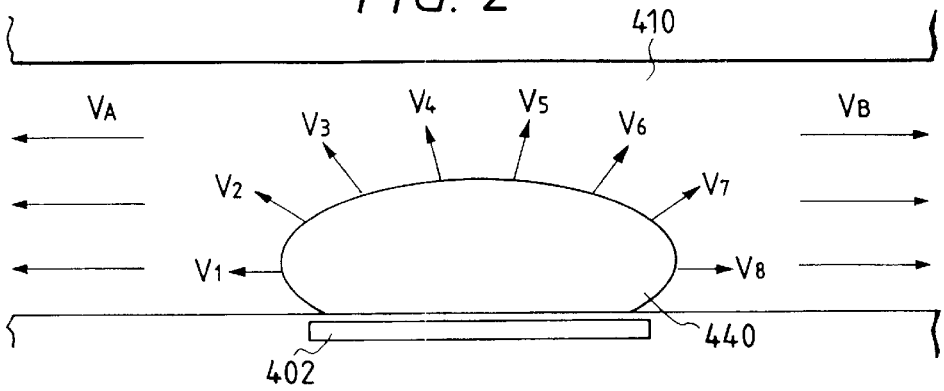
FIG. 2 is a schematic view showing the propagation of pressure from an air bubble in a head according to the prior art.
Figure 3:
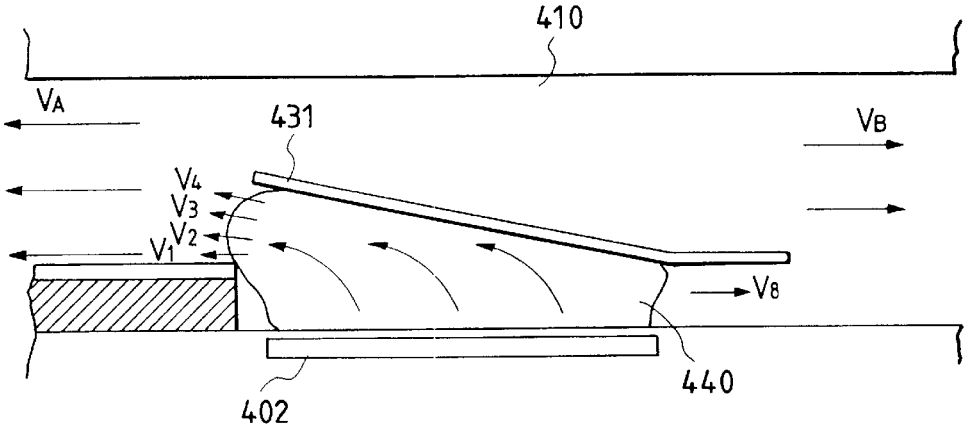
FIG. 3 is a schematic view showing the propagation of pressure from an air bubble in the head of the present invention.

This principle will be described in more detail with FIG. 2 schematically showing the liquid flow path structure according to the prior art and FIG. 3 showing the construction of the essential portions of the present invention compared with each other. Here, the direction of propagation of the pressure toward the discharge port is indicated as $V_A$, and the direction of propagation of the pressure toward the upstream side is indicated as $V_B$, and description will be made with the movable member 431 being single.

In the prior-art head as shown in FIG. 2, there is no construction for regulating the direction of propagation of the pressure by a created air bubble 440. Therefore, the direction of propagation of the pressure of the air bubble 440 has been directions perpendicular to the surface of the air bubble and has turned in various directions. Of these, particularly one having the component of the direction of propagation of the pressure in the direction $V_A$ most affecting liquid discharge is components $V_1$–$V_4$, i.e., components in the directions of propagation of the pressure in that portion of the air bubble which is nearer to the discharge port than substantially a half of the air bubble, and is an important portion which directly contributes to liquid discharge efficiency, liquid discharging force, discharge speed, etc. Further, $V_1$, which is nearest to the discharge direction $V_A$, works efficiently, and conversely $V_4$ is relatively small in the amount of the direction component travelling toward $V_A$.

In contrast, in the case of the present invention shown in FIG. 3, the movable member 431 directs the directions $V_1$–$V_4$ of propagation of the pressure of the air bubble which have turned in various directions as in the case of FIG. 2 toward the downstream side (the discharge port side) and converts them into the direction $V_A$ of propagation of the pressure, whereby the pressure of the air bubble 440 directly and efficiently contributes to the discharge. The direction itself of growth of the air bubble is directed in the downstream direction like the directions $V_1$–$V_4$ of propagation of the pressure, and the air bubble grows more greatly downstream than upstream. Thus, the direction itself of growth of the air bubble is controlled by the movable member and the directions of propagation of the pressure of the air bubble are controlled, whereby fundamental improvements in discharge efficiency, discharging force, discharge speed, etc. can be achieved.

Description will now be made of the discharging operation of the liquid discharging head according to the present embodiment. FIGS. 4A to 4D are schematic cross-sectional views for illustrating the discharging operation of the liquid discharging head according to the present embodiment. In FIG. 4A to 4D, to make the description readily understood, the supporting member 405*b* is omitted.

Figure 4A:
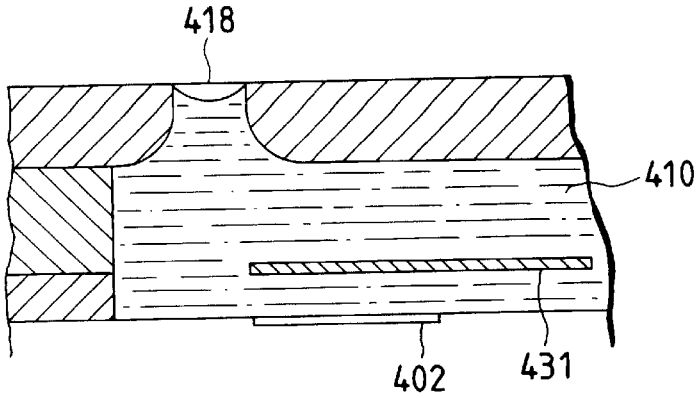
FIGS. 4A, 4B, 4C and 4D are cross-sectional views continuously showing the discharging operation by a first embodiment of the present invention.

FIG. 4A shows the state before energy such as electrical energy is applied to the heat generating member 402, i.e., the initial state before the heat generating member generates heat.

Figure 4B:
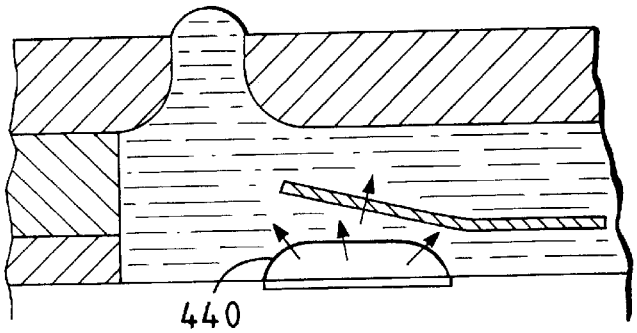

FIG. 4B shows a state in which electrical energy or the like is applied to the heat generating member 402 and the heat generating member 402 generates heat and by the generated heat, an air bubble 440 resulting from film boiling is created and is growing. The pressure resulting from the creation and growth of this air bubble propagates chiefly to the movable member 431. The mechanical displacement of this movable member 431 contributes to the discharge of the discharge liquid from the discharge port.

Figure 4C:
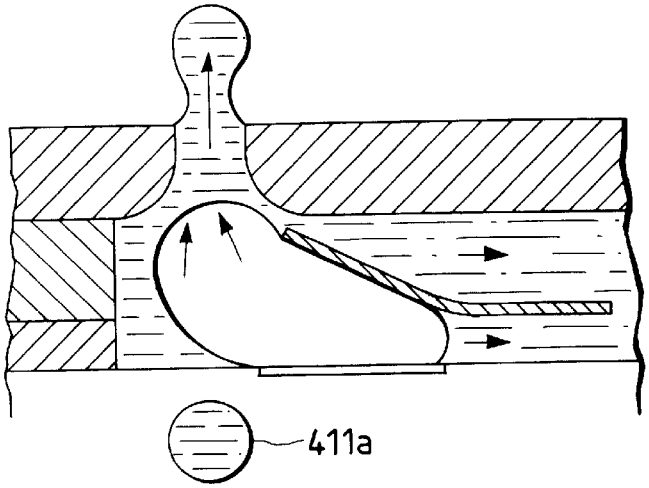

FIG. 4C shows a state in which the air bubble 440 is further grown. With the growth of the air bubble 440, the movable member 431 is further displaced toward the discharge port 418 with the base portion 406*b* thereof as a fulcrum. By this displacement of the movable member 431, the discharge port side area A and the heat generating member side area B communicate greatly with each other as compared with the initial state. This state is as if the communication path between the heat generating surface and the discharge port 418 was suitably thinly throttled by the movable member 431 to thereby concentrate the force of the air bubble toward the discharge port 418. In this manner, the pressure wave based on the growth of the air bubble 440 concentratedly propagates just upwardly toward the discharge port 418. By the direct propagation of such a pressure wave and the mechanical displacement of the movable member 431, the discharge liquid is discharged as a droplet 411*a* (FIG. 4D) from the discharge port 418 at a high speed and with a high discharging force and high discharge efficiency.

In FIG. 4C, with the displacement of the movable member 431 toward the discharge port 418, a portion of the air bubble 440 created in the heat generating member side area B extends to the discharge port side area A. By the spacing from the heat generating surface of the heat generating member 402 or the surface of the substrate 401 (see FIG. 1) to the movable member 431 being thus made into such a height that the air bubble 440 extends to the discharge port side area A, the discharging force can be further improved. To ensure the air bubble 440 to extend toward the discharge port 418 beyond the initial position of the movable member 431, it is desirable to make the height of the heat generating member side area B smaller than the height of the largest air bubble, e.g., several $\mu$m to 30 $\mu$m.

Figure 4D:
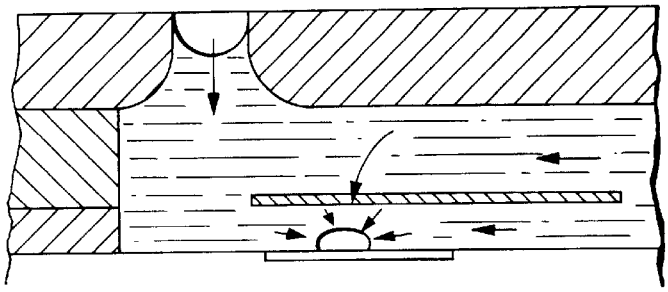

FIG. 4D shows a state in which the air bubble 440 is contracted by a decrease in the internal pressure thereof and has disappeared. The movable member 431 is returned to its initial position by the negative pressure due to the contraction of the air bubble 440 and the force of restitution due to the springiness of the movable member itself. With this, a quantity of liquid corresponding to the quantity of discharged liquid is quickly supplied in the liquid flow path 410. This is because in the liquid flow path 410, the supply of the liquid is hardly affected by the back wave due to the air bubble and is effected in parallel to the closing of the movable member 431 and is therefore little hampered by the movable member.

In the present embodiment, as described above, the movable member 431 is formed and disposed so that the free end 406*a* thereof may be upstream with respect to substantially the center of the discharge port 418 and therefore, when the movable member 431 is displaced as shown in FIG. 4C, the free end 406*a* never comes into the projection area of the discharge port 418 onto the surface of the substrate. Therefore, the growth of the air bubble 440 toward the discharge port is not impeded and a good discharging force can be obtained. The above-described arrangement of the movable member 431 and its free end 406*a* more efficiently acts with respect to the suppression of the propagation (back wave) of the pressure due to the creation of the air bubble 440 toward the upstream side, and can effect stable discharge.

Description will now be made of the refilling of the liquid in the liquid discharging head according to the present embodiment.

When the air bubble 440 has entered the disappearing process via the state of the maximum volume, a volume of liquid making up for the volume which has disappeared flows into each area from the discharge port 418 side and the liquid flow path 410. When the volume W of the air bubble 440 is made such that with the initial position of the movable member 431 as the boundary, the upper side (the discharge port side) is W1 and the lower side (the heat generating member side) is W2, the retreat of the meniscus in the discharge port 418 for compensating for a part of W1 at a point of time whereat the movable member has returned to its initial position during the disappearance of the bubble stops, whereafter the compensation for the remaining volume W2 is done chiefly by the liquid supply between the movable member 431 and the heat generating surface. Thereby, it becomes possible to reduce the amount of retreat of the meniscus in the discharge port 418.

Also, in the present embodiment, the compensation for the volume W2 can be forcibly effected chiefly from the liquid flow path 410 along the heat generating surface of the heat generating member 402 by the utilization of changes in the pressure during the disappearance of the bubble and therefore, quicker refill can be realized. Further, when refill using the pressure during the disappearance of the bubble has been effected in the prior-art head, the vibration of the meniscus has become great and this has led to the deterioration of the quality of image, while in the present embodiment, the communication between the liquids in the discharge port side area A and the heat generating member side area B is suppressed by the movable member 431 and therefore, the vibration of the meniscus can be minimized. Thereby, an improvement in the quality of image and high-speed recording can be realized.

The surface of the substrate 401 in the present embodiment is substantially flatly connected to the heat generating surface of the heat generating member 402 (the surface of the heat generating member 402 is not greatly depressed). In such a case, the supply of the liquid to the area B is done along the surface of the substrate 401. Therefore, the liquid is prevented from stagnating on the heat generating surface of the heat generating member 402, and the deposited air bubble dissolved and deposited in the liquid and the so-called residual air bubble which could not disappear and remained are easy to remove, and the heat accumulation into the liquid does not become too high. Accordingly, the more stable creation of an air bubble can be repetitively effected at a high speed. While in the present embodiment, the surface of the substrate 401 has been described with respect to an example having a sufficiently flat inner wall, this is not restrictive, but the surface of the substrate can be a liquid flow path smoothly connected to the surface of the heat generating member and having a smooth inner wall, and can be of such a shape that will not cause the stagnancy of the liquid on the heat generating member or will not cause a great turbulence in the liquid.

[Embodiment 2]

Figure 5:
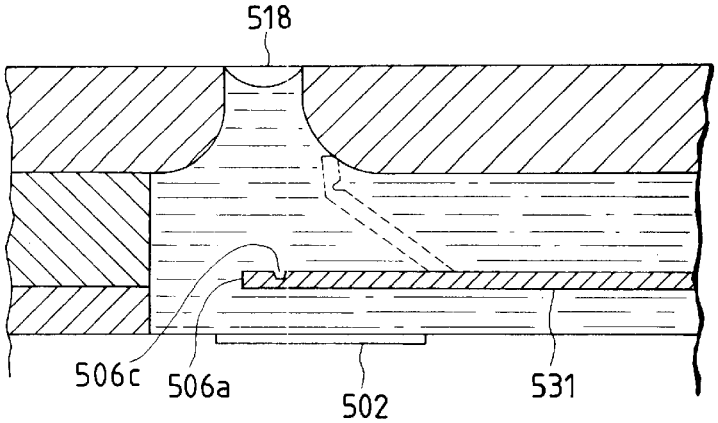
FIG. 5 is a schematic cross-sectional view showing the essential portions of a second embodiment of the present invention.

FIG. 5 is a schematic cross-sectional view showing the essential portions of a second embodiment of the liquid discharging head of the present invention. In FIG. 5, to make the description readily understood, the supporting member 405*b* in FIG. 1 is omitted.

The difference of the present embodiment from the first embodiment is that a heat generating member 502 and the free end 506*a* of a movable member 531 are disposed in the projection area of a discharge port 518, but a groove 506*c* is formed near the free end 506*a* of the movable member 531 so as to make the free end easy to flex. Thereby, as indicated by dotted line in FIG. 5, the free end 506*a* of the movable member 531 displaced by the air bubble 440 (see FIG. 3) is further flexed toward the discharge port 518. By the free end 506*a* of the movable member 531 being thus further deformed, the amount of deformation near the free end 506*a* of the movable member 531 can be greatly displaced even under relatively low bubbling pressure, and the growth of the air bubble 440 is no longer hampered and the bubbling pressure can be more efficiently turned toward the discharge port 518. Again in the present embodiment, there can be provided a liquid discharging head of high discharging force and high discharge efficiency.

[Embodiment 3]

FIGS. 6A to 6D are cross-sectional views continuously showing the structure and discharging operation of a third embodiment of the present invention.

The present embodiment communicates an air bubble created to discharge the liquid with the atmosphere without the air bubble being made to disappear in the liquid.

The end portion 606*a* of a movable member 631 and a heat generating member 602 are both disposed in the projection area of a discharge port 618. Also, a barrier 605 on the left as viewed in FIG. 6A and formed on a barrier supporting portion 604 is inclined so as to make the cross-sectional area of a liquid flow path 610 smaller toward the discharge port 618.

Although not shown in each figure, a common liquid chamber is provided on the right in the figures, and the liquid flow path is of a bent shape.

Figure 6A:
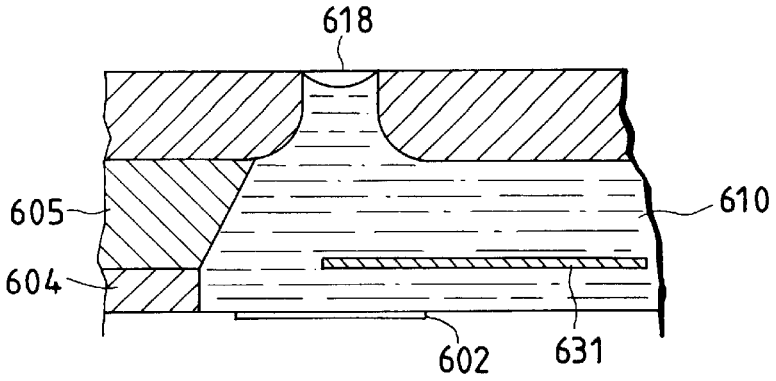
FIGS. 6A, 6B, 6C and 6D are cross-sectional views continuously showing the discharging operation by a third embodiment of the present invention.

The state shown in FIG. 6A is that before energy such as electrical energy is applied to the heat generating member 602, that is, before the heat generating member 602 generates heat. Again in the present embodiment, the movable member 631 is provided at a location facing at least the downstream side portion of an air bubble created by the heat generation of the heat generating member 602, and is disposed to a location downstream of at least the center of area of the heat generating member 602 in the structure of the liquid flow path (downstream of a line passing through the center of area of the heat generating member and orthogonal to the lengthwise direction of the flow path) so that the downstream side of the air bubble may act on the movable member 631.

Figure 6B:
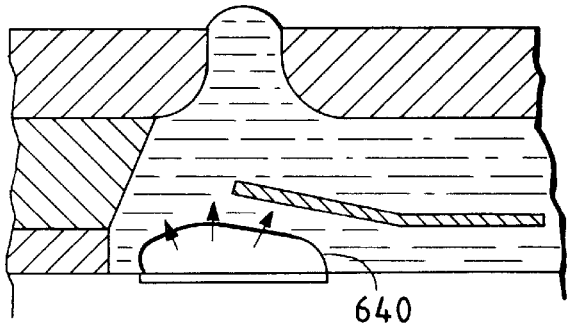

FIG. 6B shows a state in which electrical energy or the like has been applied to the heat generating member 602 and the heat generating member 602 has generated heat and part of the liquid filling the air bubble creating area is heated by the generated heat and an air bubble resulting from film boiling has been created.

At this time, the movable member 631 is displaced by the pressure based on the creation of the air bubble 640 so as to direct the direction of propagation of the pressure of the air bubble 640 toward the discharge port 618 through a wall surface.

What is important here is to dispose the free end 606*a* of the movable member 631 on the downstream side (the discharge port 618 side), dispose the displacement fulcrum of the movable member 631 so as to be located on the upstream side (the common liquid chamber side), and make at least a portion of the movable member 631 face the downstream portion of the heat generating member 602, i.e., the downstream portion of the air bubble 640, as previously described.

Figure 6C:
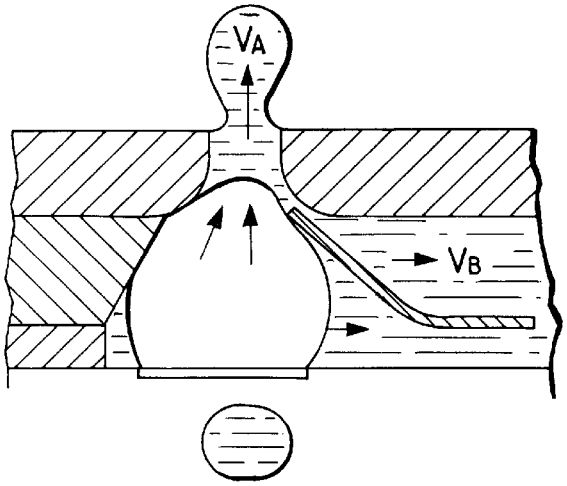

FIG. 6C shows a state in which the air bubble 640 has further grown, and the movable member 631 is further displaced in conformity with the pressure resulting from the creation of the air bubble 640.

Also, since the barrier 605 is inclined so as to make the cross-sectional area of the liquid flow path 610 smaller toward the discharge port 618, the growth of the air bubble 640 is regulated to substantially the same shape by the movable member 631 and the barrier 605 as is apparent from FIG. 6C, with respect to at least the cross-sectional direction shown, and the directionality of discharge thereof becomes stable.

The created air bubble 640 grows more greatly downstream than upstream and has grown greatly beyond the initial position of the movable member 631 shown in FIG. 6A. The movable member 631 hardly hinders the propagation of the air bubble 640 and the bubbling pressure when it directs them toward the discharge port 618, and can efficiently control the direction of propagation of the pressure and the direction of growth of the air bubble 640 in conformity with the magnitude of the pressure to be propagated.

As described above, the movable member 631 is gradually displaced in conformity with the growth of the air bubble 640, whereby the direction of propagation of the air bubble 640 and the direction in which the movement of the volume of the air bubble readily takes place, i.e., the direction of growth of the air bubble 640 toward the free end 606*a* of the movable member 631, can be uniformly turned toward the discharge port 618. Also, the speed $V_A$ at which with this, the liquid moves toward the discharge port 618 becomes sufficiently greater than the speed $V_B$ at which the liquid moves in the direction B toward the upstream side, and the discharge efficiency becomes high.

Also, even in the state immediately before the air bubble 640 communicates with the atmosphere, the air bubble 640 in the liquid path does not completely cut off the liquid flow path in its growth stage and therefore, the present embodiment is excellent in the refilling characteristic for the subsequent ink recording.

In the present embodiment, as parameters which determine the created air bubble 640, mention may be made of the amount of heat energy generated by the heat generating member 602 (the construction of the heat generating member 602, the material forming the heat generating member 602, the driving condition thereof, the area thereof, the heat capacity of the substrate on which the heat generating member 602 is provided, etc.), the physical property of the ink, the size of each portion of the recording head (the distance between the discharge port 618 and the heat generating member 602, and the widths and heights of the discharge port 618 and the liquid flow path), etc., and by suitably selecting these, the air bubble 640 can be communicated with the atmosphere in a desired state.

Figure 6D:
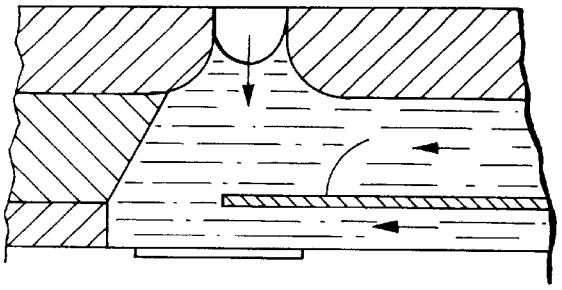

FIG. 6D shows a state in which the air bubble 640 has communicated with the atmosphere and the liquid has been discharged. As shown, in the present embodiment, owing to the provision of the movable member 631, even in the state in which the air bubble 640 has communicated with the atmosphere, the discharged liquid is not one-sided relative to the surroundings of the discharge port and comes off the discharge port with uniform balance and thus, stable directionality of discharge is obtained.

Also, the discharge liquid comes to include much of the portion which has formed the interface with the air bubble 640 before the air bubble 640 communicates with the atmosphere. The temperature distribution of the liquid during the creation of the air bubble 640 is such that the temperature of the interface with the air bubble 640 is highest, and in the present embodiment, the liquid in this portion is discharged and therefore, the temperature rise of the head is suppressed to a low level.

After the discharge, the movable member 631, as shown in FIG. 6D, returns gradually until the displacement thereof assumes the initial state, but meniscuses are formed above and below the free end of the movable member 631 until it assumes its initial state, and the movable member 631 returns to its initial state while being displaced so that the forces of the respective meniscuses may be balanced with each other, and the refilling of the liquid is also completed.

The refilling operation in the present embodiment is similar to that in the first embodiment, and is performed quickly and the production of vibration during refill is suppressed, and the movable member can early return to its initial state.

The shape of the barrier supporting portion 604 may be such a tapered shape that the opening surface thereof may become narrower toward the discharge port 618 side with a view to prevent the bubble from remaining after discharge, and leave the liquid during the discharge as well. By adopting such a tapered shape, the liquid always stagnates in this portion even when the discharging operation is performed, and the creation of a bubble is prevented.

Also, the tapered shape of the barrier supporting portion 604 may be such that conversely to the above-described case, the opening surface becomes wider toward the discharge port 618 side. In the case of such a shape, the air which has entered after the air bubble has communicated with the atmosphere during the return of the movable member 631 after the displacement thereof is efficiently guided to the discharge port 618 side and is discharged from the discharge port 618 without leaving any air bubble in the liquid flow path which is the lower portion of the movable member 631 and at the same time, the completion of refilling is quickened and therefore, high-speed driving becomes possible. Also, even if there is a gas which is covered with the liquid and has assumed a bubble-like shape, it can be discharged from the air bubble forming area by the inclination of the displacement of the movable member 631 and a change in the pressure thereof and this tapered portion and therefore, the stabilization of air bubble formation and discharge efficiency can be kept.

[Embodiment 4]

Figure 7A:
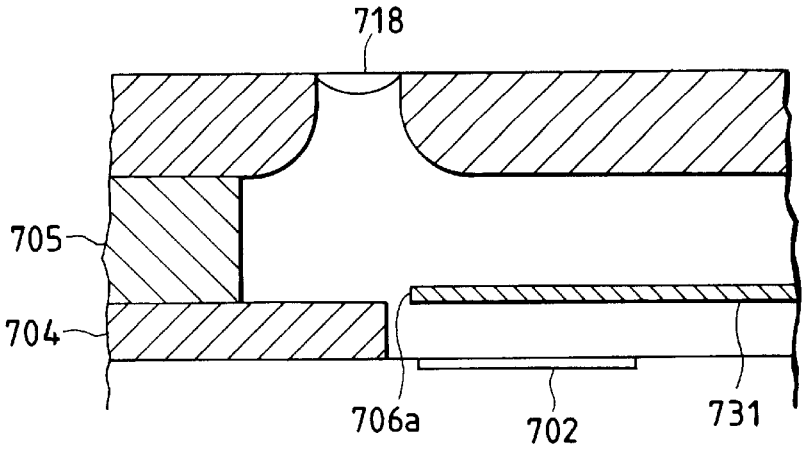
FIGS. 7A and 7B are schematic cross-sectional views of a fourth embodiment of the present invention.
Figure 7B:
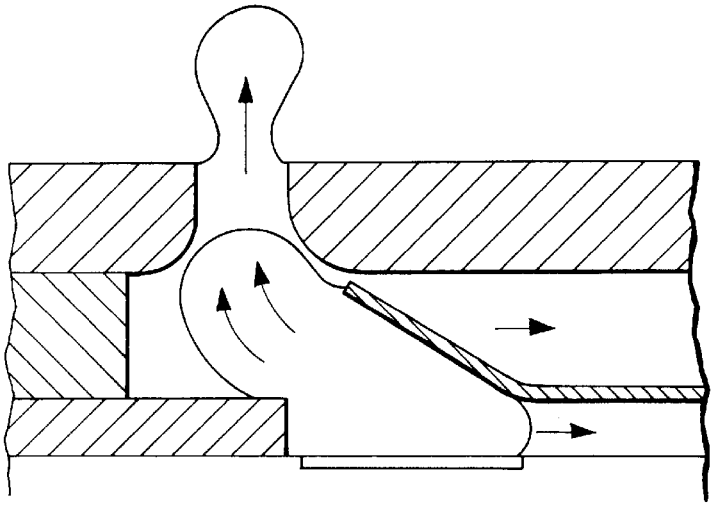

FIGS. 7A and 7B are cross-sectional views showing the construction of a fourth embodiment of the present invention, FIG. 7A shows the initial state, and FIG. 7B shows the state during discharge.

The positional relations among a heat generating member 702, the end portion 706*a* of a movable member 731 and a discharge port 718 in the present embodiment are similar to those in the first embodiment, but with a view to efficiently effect the displacement of the movable member by the air bubble, a barrier supporting portion 704 extends to the vicinity of the end portion 706*a* of the movable member 731 when in the initial state shown in FIG. 7A.

As described above, the barrier supporting portion 704 extends, whereby the force by a created air bubble immediately travels in a direction to push up the movable member 731, and thereafter travels toward the discharge port 718 and thus, discharge can be effected efficiently. Also, the improved efficiency enables even a liquid of high viscosity such as polyethylene glycol which has been difficult to sufficiently bubble even if heat is applied thereto and of which the discharging force has been insufficient to be discharged well.

[Embodiment 5]

Figure 8:
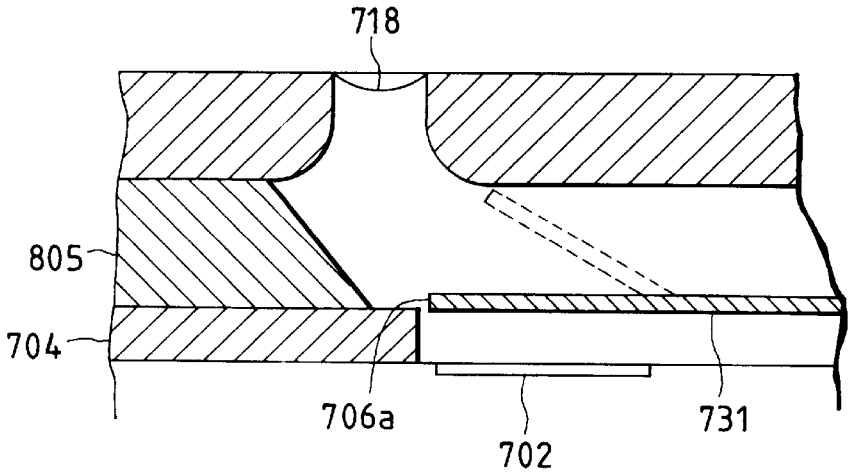
FIG. 8 is a cross-sectional view showing the construction of a fifth embodiment of the present invention.

FIG. 8 is a cross-sectional view showing the construction of a fifth embodiment of the present invention.

This embodiment is one in which the barrier 705 in the fourth embodiment shown in FIGS. 7A and 7B is made into a barrier 805 inclined so that the cross-sectional area of the flow path leading toward the discharge port 718 may become smaller in order to make a created air bubble ready to grow toward the discharge port 718. In the other points, the construction of this embodiment is similar to that of the fourth embodiment shown in FIGS. 7A and 7B and therefore, like portions are designated by like reference numerals. By adopting such a shape, the created air bubble has become stable in its growth toward the discharge port 718 and the discharge of the liquid by its outward growth.

[Embodiment 6]

FIGS. 9A to 9E are cross-sectional views showing a sixth embodiment of the present invention.

The liquid discharging head of this embodiment is a head of the so-called side shooter type in which a discharge port O is disposed so as to face the heat generating surface of a heat generating member H substantially in parallelism thereto. The heat generating member H (in the present embodiment, a heat generating resistance member of 48 $\mu$m×46 $\mu$m) is provided on a substrate 2, and generates heat energy utilized to cause film boiling) as described in U.S. Pat. No. 4,723,129 in a liquid to thereby create an air bubble. The discharge port 0 is provided in an orifice plate OM which is a discharge port member. This orifice plate OM is fixed to and supported by a support member 1 and is formed by electrocasting nickel.

A liquid flow path 10 for letting the liquid flow therethrough is provided between the orifice plate OM and the substrate 2 so as to directly communicate with the discharge port 0. In the present embodiment, ink of water line is used as the liquid to be discharged.

In the liquid flow path 10, there are provided two movable members M1 and M2 of a flat plate cantilever beam shape in opposed relationship with the heat generating member H. The movable members M1 and M2 are located near the upward projection space of the heat generating surface in a direction perpendicular to the heat generating surface of the heat generating member H and are disposed so as to be opposed to each other with a direct communication area directly communicating with the discharge port O through the heat generating member H and the slit SL of the movable members M1 and M2 interposed therebetween. The movable members M1 and M2 are formed of a resilient material such as a metal. In the present embodiment, they are formed of nickel having a thickness of 5 $\mu$m. The fulcrum side of the movable members M1 and M2 is fixed to and supported by a supporting member 5*b*. The supporting member 5*b* is formed by patterning photosensitive resin on the substrate 2.

The movable members M1, M2 and the heat generating surface are disposed at an interval of the order of 15 μm.

A portion of the movable members M1 and M2 including at least the free ends thereof faces the heat generating member H, and is disposed in an area which the pressure by the air bubble directly reaches. Also, the slit SL of the free ends of the movable members M1 and M2 has an area which the growing component of the air bubble directly travels toward the discharge port O, and the width thereof is 5 μm—discharge port diameter ϕO in order that the other component than the component travelling toward the discharge port O may be directed to the discharge port O by the displacement of the movable members M1 and M2.

Figure 9A:
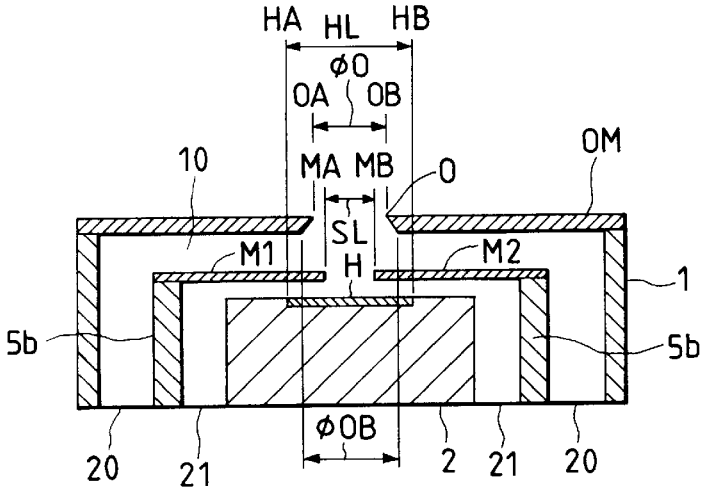
FIGS. 9A, 9B, 9C, 9D and 9E are cross-sectional views of the discharge nozzle of a sixth embodiment of the liquid discharging head according to the present invention.

The disposition of each member in the present embodiment is as shown in FIG. 9A. The heat generating member H is such that the positions of the heat generating surface of the heat generating member H and the end portion of the discharge port O with respect to the horizontal direction (the left to right direction as viewed in FIG. 9A substantially parallel to the discharge surface of the discharge port O are defined as HA and HB, respectively, and the length between these positions is defined as HL. The positions of the free ends of the movable members M1 and M2 with respect to the horizontal direction are defined as MA and MB, respectively, and the space between these positions is the slit SL. The discharge port O formed in the orifice plate OM is formed into a tapered shape of which the diameter becomes smaller toward the outside to stabilize the shape of the discharge liquid. Therefore, the diameters formed on the outer surface and inner surface of the orifice plate OM differ from each other, and the discharge diameter ϕ0 formed on the outer surface is largest at positions OA and OB with respect to the horizontal direction, and the discharge diameter ϕOB formed on the inner surface is larger than ϕO.

Also, a liquid supply path 21 is formed by the substrate 2 being surrounded by the supporting member 5*b* and the movable members M1, M2, and a liquid supply path 20 is formed by the outside thereof being further surrounded by the supporting member 1 and the orifice plate OM.

Figure 9B:
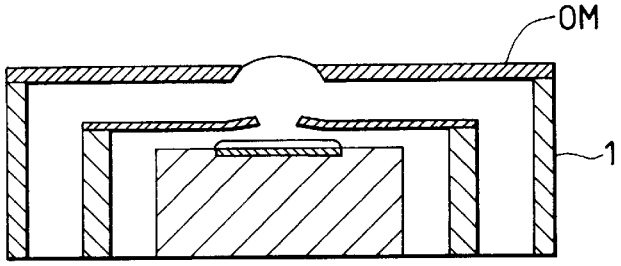

When as shown in FIG. 9B, heat is generated from the heat generating surface of the heat generating member H to thereby create an air bubble in the liquid, one of the directions of growth of the pressure wave by the creation of the air bubble and the air bubble itself which turns toward the discharge port directly acts on the discharge port O through the slit SL to thereby start the liquid discharging operation and heap up the meniscus. The pressure wave and the direction of growth on the end portion of the air bubble radially widen and therefore do not directly turn toward the discharge port O, but yet in this portion, there are disposed the movable members M1 and M2 and the displacement of the movable members M1 and M2 is caused.

Figure 9C:
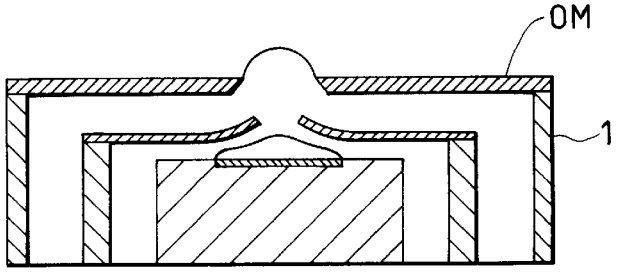

FIG. 9C shows a state in which the air bubble has further grown to thereby increase the swelling of the meniscus and the displacement of the movable members M1 and M2. At this time, there is shown a shape in which particularly the growing component of the air bubble is further gathered to the center of the discharge port by the displacement of the movable members M1 and M2 and yet is directed to the discharge port O.

Figure 9D:
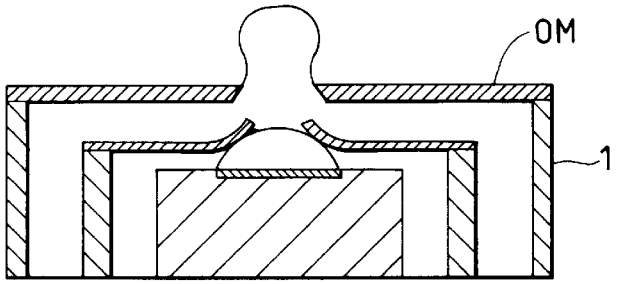

FIG. 9D shows a state in which the air bubble has further grown and has grown to the vicinity of its maximum volume, and the grown air bubble is further directed to the discharge port O by the movable members M1 and M2. In this case, the movable members M1 and M2 are displaced so that the pressure component may not escape to the first liquid flow path 10 side and also are displaced into a state completely liberated relative to the discharge port diameter ϕO and therefore, discharge efficiency reaches its highest state.

Figure 9E:
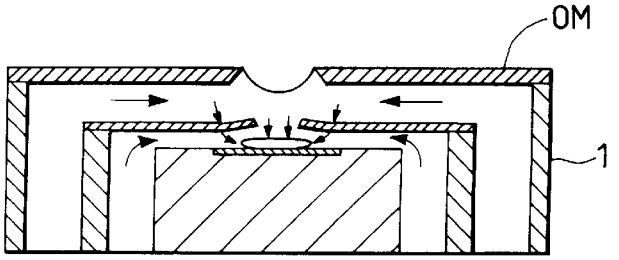

FIG. 9E shows the process of contraction of the air bubble, and the air bubble is rapidly contracting with a decrease in the internal pressure, and with it, the air bubble draws in the meniscus from the discharge port O and at the same time, the movable members M1 and M2 return from their displaced positions to their natural positions, thereby smoothly effecting liquid supply. Therefore, the draw-in of the meniscus is suppressed to a small level.

Figure 10:
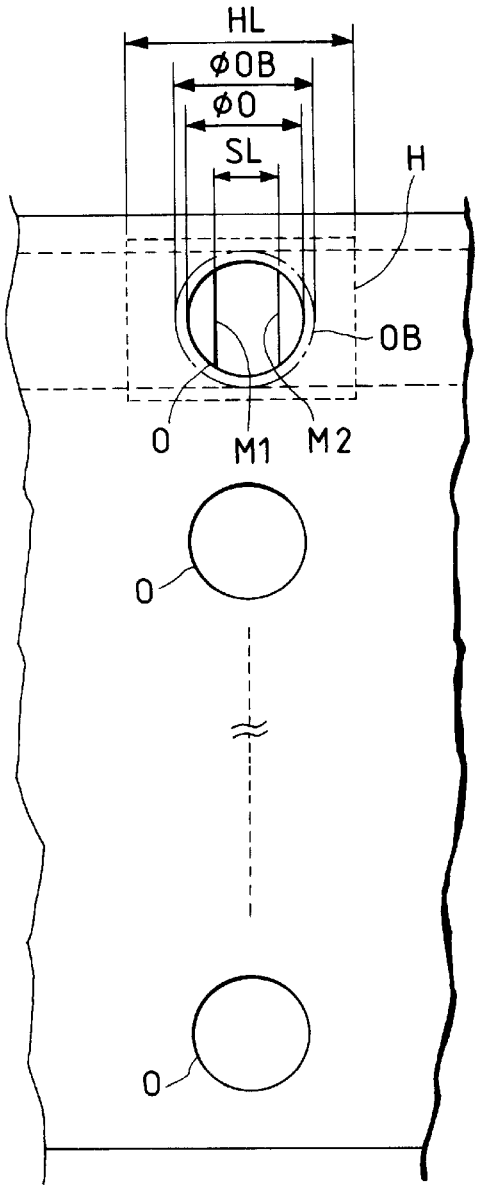
FIG. 10 is a plan view of the embodiment shown in FIGS. 9A to 9E.

FIG. 10 shows a head face on which a plurality of discharge ports O are disposed as it is seen from the direction of liquid discharge. From the openings in the discharge ports O, a portion including the free ends of the movable members M1 and M2 can be seen if the liquid is transparent. Further, a portion of the heat generating member H can be seen through the slit SL at the free ends. The slit SL at the free ends has a width of 5 μm or greater, and has a direct communication area for propagating the pressure of the air bubble by the heat generating member H directly to the discharge ports 0. The slit SL is made to have a width of 5 μm, whereby the direct communication area can be secured. Also, the slit SL is narrower than the discharge port diameter ϕO and therefore, by being displaced as previously described, it can control the air bubble so as to be directed toward the discharge ports O.

The application of an electrical signal to the heat generating member H which is an electro-thermal converting member is effected by a wiring electrode (not shown) disposed on the substrate 2.

One of the basic principles of discharge of the present invention will now be described. One of the most important principles in the present invention is that the movable members M1 and M2 disposed so as to face the air bubble are displaced from a first position which is a steady state to a second position which is a position after displacement, on the basis of the pressure of the air bubble or the air bubble itself, and by these displaced movable members M1 and M2, the pressure resulting from the creation of the air bubble or the air bubble itself is directed to the downstream side on which the discharge ports O are disposed.

[Embodiment 7]

A seventh embodiment of the present invention will now be described.

Figure 11:
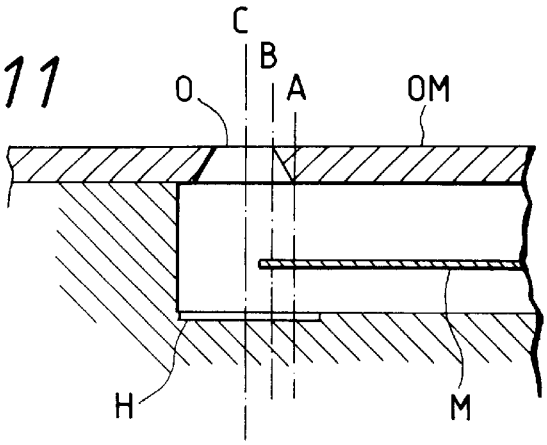
FIG. 11 is a schematic cross-sectional view showing the essential portions of a seventh embodiment of the present invention.

FIG. 11 is a cross-sectional view showing the construction of a seventh embodiment of the present invention in which a movable member M is provided only on one side.

The movable member M is displaced by the creation of an air bubble, whereby it cooperates with a fixed member (a wall) opposed to the movable member M to direct the pressure and growing component of the air bubble to a discharge port O formed in an orifice plate OM. In the present embodiment, the free end of the movable member M is made such that the position thereof with respect to a horizontal direction (the left to right direction as viewed in FIG. 11) substantially parallel to the heat generating surface of the heat generating member H and the discharge surface of the discharge port O exceeds the end portions A and B of the discharge port O formed on the inner surface and outer surface, respectively, of the orifice plate OM, but does not reach the central portion C of the heat generating member H. Thus, the heat generating member H has a direct communication area directly communicating with the discharge port O, and that component of the air bubble created by the heat generating member H which travels toward the discharge port O is directed to the discharge port O without being hampered, and that component of the air bubble which does not travel toward the discharge port O is directed to the discharge port O by the displacement of the movable member M, and discharge efficiency can be more improved.

[Embodiment 8]

Figure 12A:
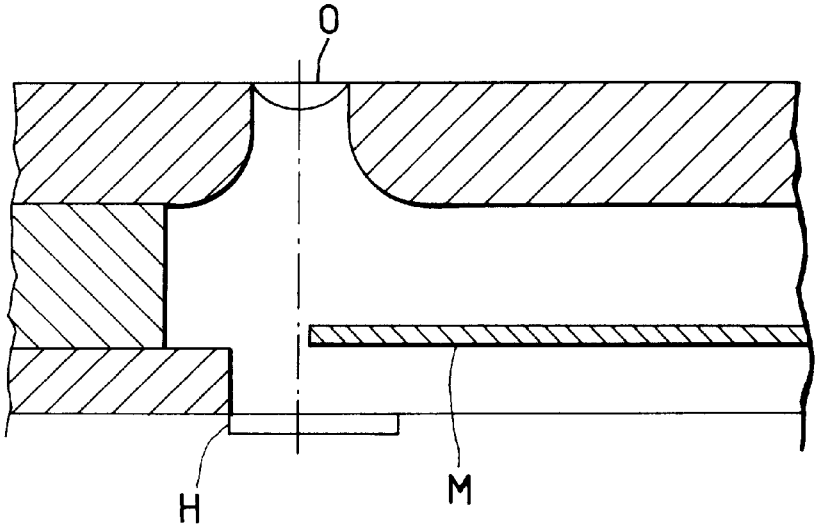
FIGS. 12A and 12B are cross-sectional views showing an eighth embodiment of the present invention.
Figure 12B:
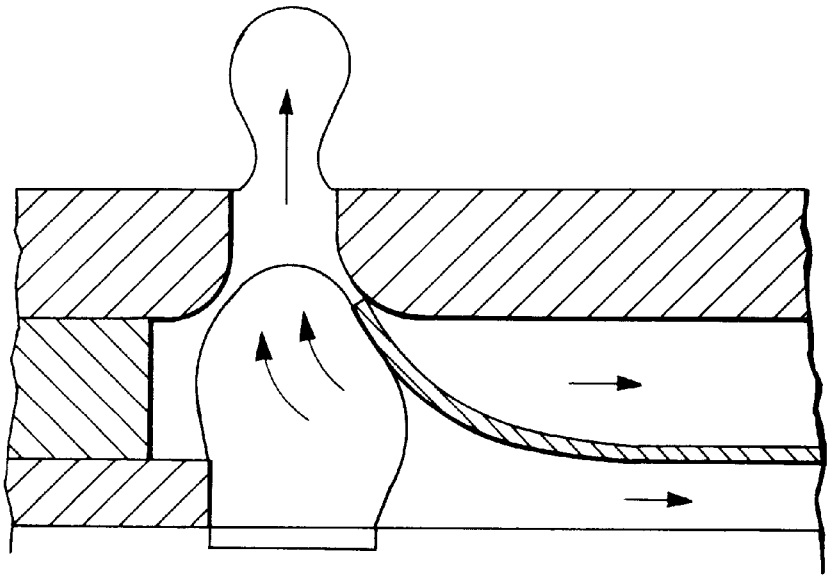

FIGS. 12A and 12B are cross-sectional views showing the actual discharging operation of an eighth embodiment of the present invention.

This embodiment, like the sixth and seventh embodiments shown in FIGS. 9A to 9E, 10 and 11, secures an atmosphere communication area, and yet, like the fourth embodiment shown in FIGS. 7A and 7B, disposes a barrier supporting portion near the free end of the movable member M to thereby improve discharge efficiency. With such a construction, the effects of the respective embodiments are combined, and discharge efficiency and refilling characteristic are improved.

In the embodiments as described above wherein an air bubble is created to thereby perform the discharging operation, it is important that no air bubble is left in the discharge nozzle after discharge. If a part of the air bubble remains in the air bubble creating area, the creation of an air bubble will become unstable and thus discharge will become unstable, and if the air bubble remains in the discharge area, irregularity will occur to the discharge liquid and thus, recording will not be done stably. As described above, the barrier supporting portion which is the end portion of the bottom surface is worked into a tapered shape, whereby there can be adopted a construction for preventing the stagnation of the air bubble, but also by the driving condition of the heat generating member, the stagnation of the air bubble can be prevented. As such a driving condition, it may be mentioned to slightly move the movable member to stabilize the state of the liquid around the movable member, and particularly below the movable member, after discharge, and by combining such a driving condition with an ordinary driving condition for effecting discharge, stable discharge can be effected.

The discharging method according to the present invention will hereinafter be described with the ordinary driving condition for effecting discharge defined as driving condition A and with the driving condition for slightly moving the movable member to stabilize the state of the liquid around the movable member after discharge defined as driving condition B.

Figure 13:
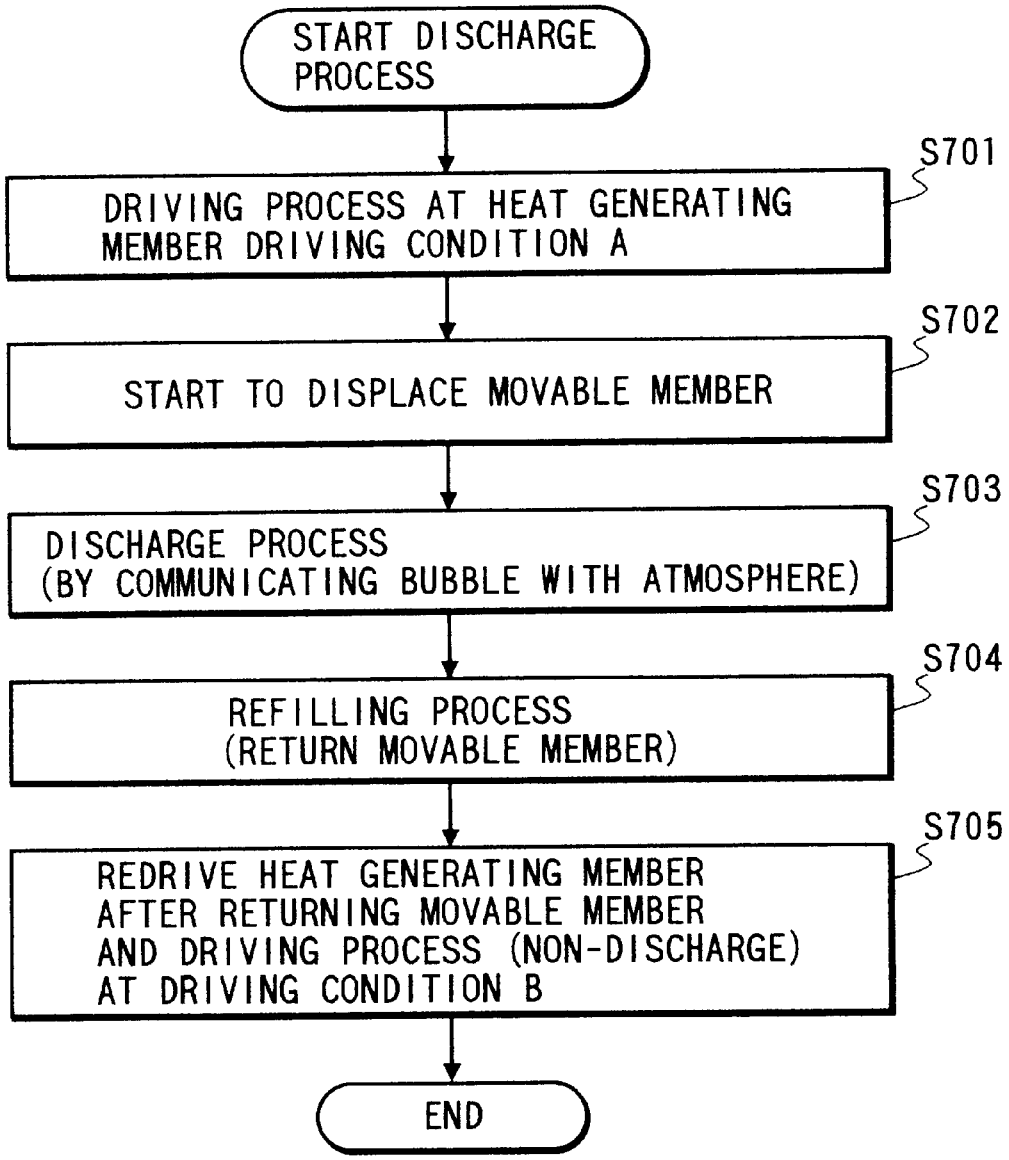
FIG. 13 is a flow chart showing the discharging method according to the present invention.

FIG. 13 is a flow chart showing a discharging method comprising a combination of the driving conditions as described above. To perform the discharging operation, driving by driving condition A is first effected (step S701). Thereby, the movable member is displaced as described in connection with each embodiment (step S702), and discharge is done in a state in which the air bubble communicates with the atmosphere (step S703), and refilling is effected (step S704). Thereafter, driving by driving condition B is effected, whereby the unnecessary air bubble in the liquid is discharged (step S705), and discharge is terminated.

During the discharge, the above-described steps are executed as a series of operations, whereby the air bubble can be prevented from stagnating in the liquid, and good recording can be accomplished.

<Liquid>

As described in connection with the previous embodiments, in the present invention, by the construction having the movable member as previously described, the liquid can be discharged with higher discharging force and discharge efficiency and moreover at a higher speed than in the prior-art liquid discharging head. In the present embodiment, use can be made of any of various liquids which are not degteriorated by the heat applied from the heat generating member and in which it is difficult for deposits to be created on the heat generating member by heating and of which the reversible state changes such as gasification and condensation are possible by heat and further which do not deteriorate the liquid flow path, the movable member, the separating wall, etc.

Among such liquids, as the liquid used for effecting recording (recording liquid), use can be made of the ink of the composition used in the conventional bubble jet apparatuses.

In the present invention, recording was effected by the use of ink of the following composition as the recording liquid, and since the discharge speed of the ink became higher due to an improvement of the discharging force, the accuracy of shooting of liquid droplets was improved and very good recorded images could be obtained.

Dye Ink having a viscosity of 2 cp:

| | |
|---|---|
| (C.I. food black 2) dye | 3 wt % |
| diethylene glycol | 10 wt % |
| thiodiglycol | 5 wt % |
| ethanol | 3 wt % |
| water | 77 wt % |

Now, in the case of the liquid heretofore regarded as being difficult to discharge as previously described, it has been difficult to obtain images of high quality because the discharge speed is low and therefore the irregularity of discharge directionality is furthered and the accuracy of shooting of dots on recording paper is bad and the irregularity of the amount of discharge due to the instability of discharge occurs. However, in the construction of the above-described embodiments, the creation of the air bubble can be effected sufficiently and moreover stably by using a bubbling liquid. Thus, an improvement in the accuracy of shooting of liquid droplets and the stabilization of the amount of discharged ink could be achieved and the quality of recorded images could be remarkably improved.

<Liquid Discharging Head Cartridge>

A liquid discharging head cartridge carrying therein the liquid discharging head according to the above-described embodiments will now be roughly described.

Figure 14:
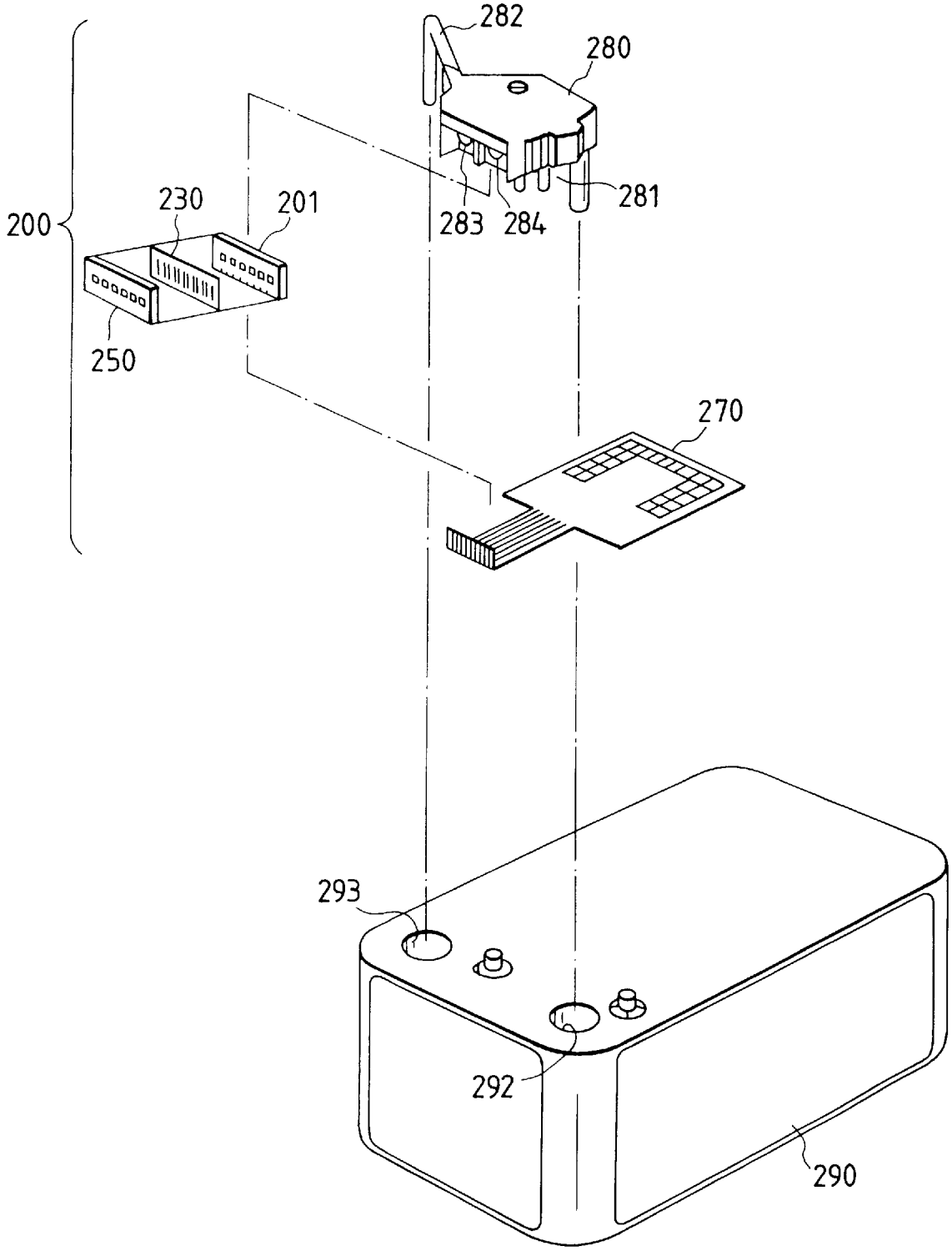
FIG. 14 is an exploded perspective view of a liquid discharging head cartridge.

FIG. 14 is a schematic exploded perspective view of a liquid discharging head cartridge including the afore-described liquid discharging head, and the liquid discharging head cartridge is comprised chiefly of a liquid discharging head portion 200 and a liquid container 80.

The liquid discharging head portion 200 comprises a substrate 201, a separating wall 230, a grooved member 250, a keep spring (not shown), a liquid supply member 290, a support member 270, etc. On the substrate 201, a plurality of heat generating resistance members for giving heat to the bubbling liquid as previously described are provided in a row, and a plurality of functional elements for selectively driving these heat generating resistance members are also provided. A liquid path is formed between the substrate 201 and the separating wall 230 having a movable wall and the liquid flows through the liquid path. By the joining of this separating wall 230 and the grooved member 250, there is formed a flow path (not shown) through which the liquid to be discharged flows.

The keep spring is a member for causing a biasing force toward the substrate 201 to act on the grooved member 250, and by this biasing force, the substrate 201, the separating wall 230, the grooved member 250 and the support member 270 which will be described later are well made integral with one another.

The support member 270 is for supporting the substrate 201, etc., and on this support member 270, there are further disposed a circuit substrate connected to the substrate 201 to supply an electrical signal thereto, and a contact pad connected to the apparatus side to exchange an electrical signal with the apparatus side.

The liquid container 290 contains therein a liquid such as ink to be supplied to the liquid discharging head. Outside the liquid container 290, there are provided a positioning portion for disposing a connecting member for making the connection between the liquid discharging head and the liquid container, a fixing shaft for fixing the connecting member, etc. The liquid is supplied from the liquid supply paths 292, 293 of the liquid container through the connecting member to the liquid supply paths 281, 282 of a liquid supply member 280, and through liquid supply paths 283, 284 to a common liquid chamber.

This liquid container may be refilled with liquid after the consumption of each liquid and used. For this purpose, a liquid introduction port may desirably be provided in the liquid container. Also, the liquid discharging head and the liquid container may be integral with each other or may be separable from each other.

<Liquid Discharging Device>

Figure 15:
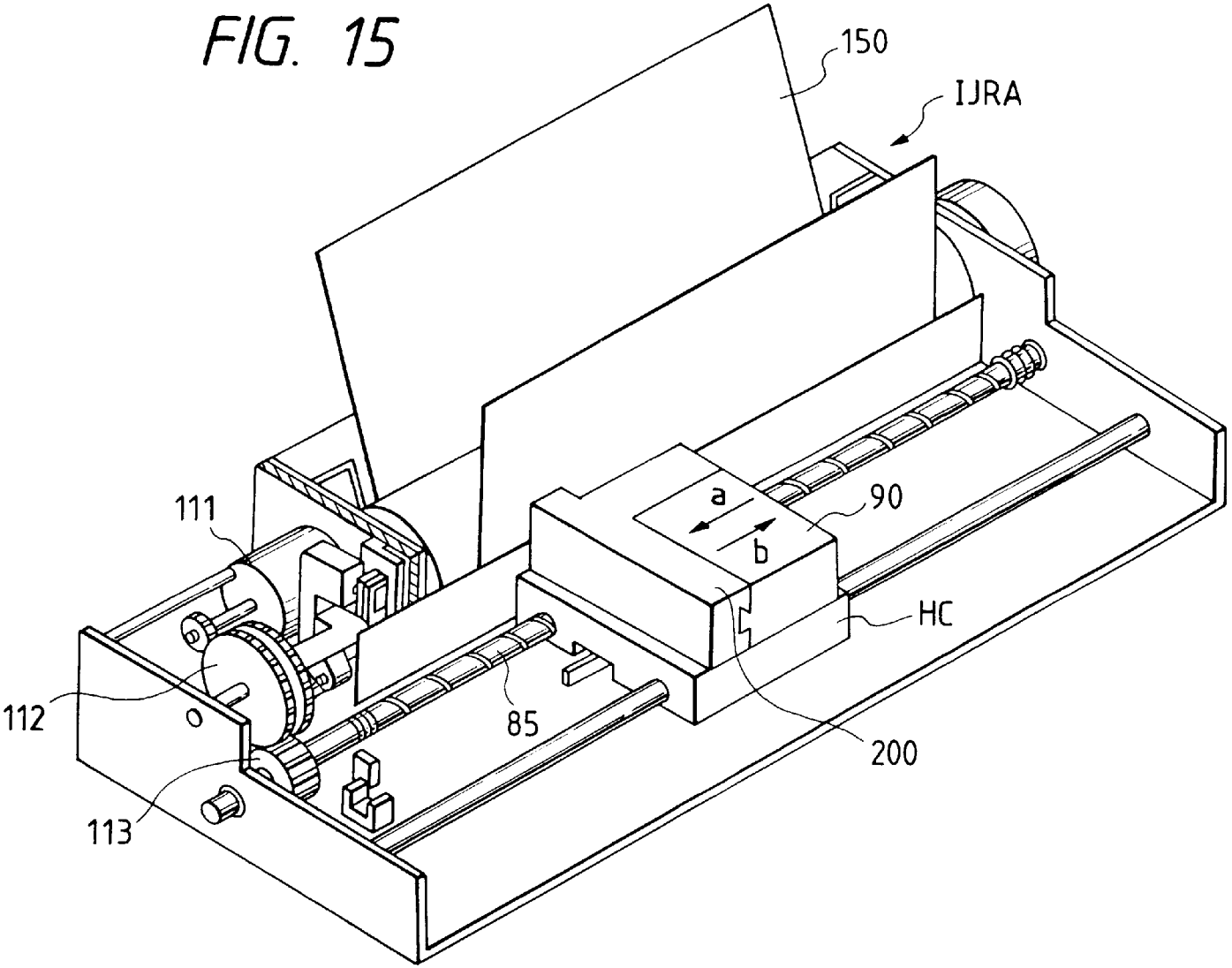
FIG. 15 schematically shows the construction of a liquid discharging device.

FIG. 15 schematically shows the construction of a liquid discharging device carrying the aforedescribed liquid injection head thereon. In the present embodiment, the carriage HC of the liquid discharging device described by the use of an ink discharge recording apparatus using particularly ink as discharge liquid carries thereon a head cartridge on which a liquid tank portion 90 containing the ink therein and a liquid discharging head portion 200 are removably mountable, and is reciprocally moved in the widthwise direction of a recording medium 150 such as recording paper conveyed by recording medium conveying means.

When a driving signal is supplied from driving signal supply means, not shown, to liquid discharging means on the carriage, recording liquid is discharged from the liquid discharging head to the recording medium in response to this signal.

Also, the liquid discharging device of the present embodiment has a motor 111 as a drive source for driving the recording medium conveying means and the carriage, gears 112, 113 for transmitting the power from the drive source to the carriage, a carriage shaft 115, etc. By this recording apparatus and the liquid discharging method carried out by this recording apparatus, the liquid was discharged to various kinds of recording mediums, whereby records of good images could be obtained.

Figure 16:
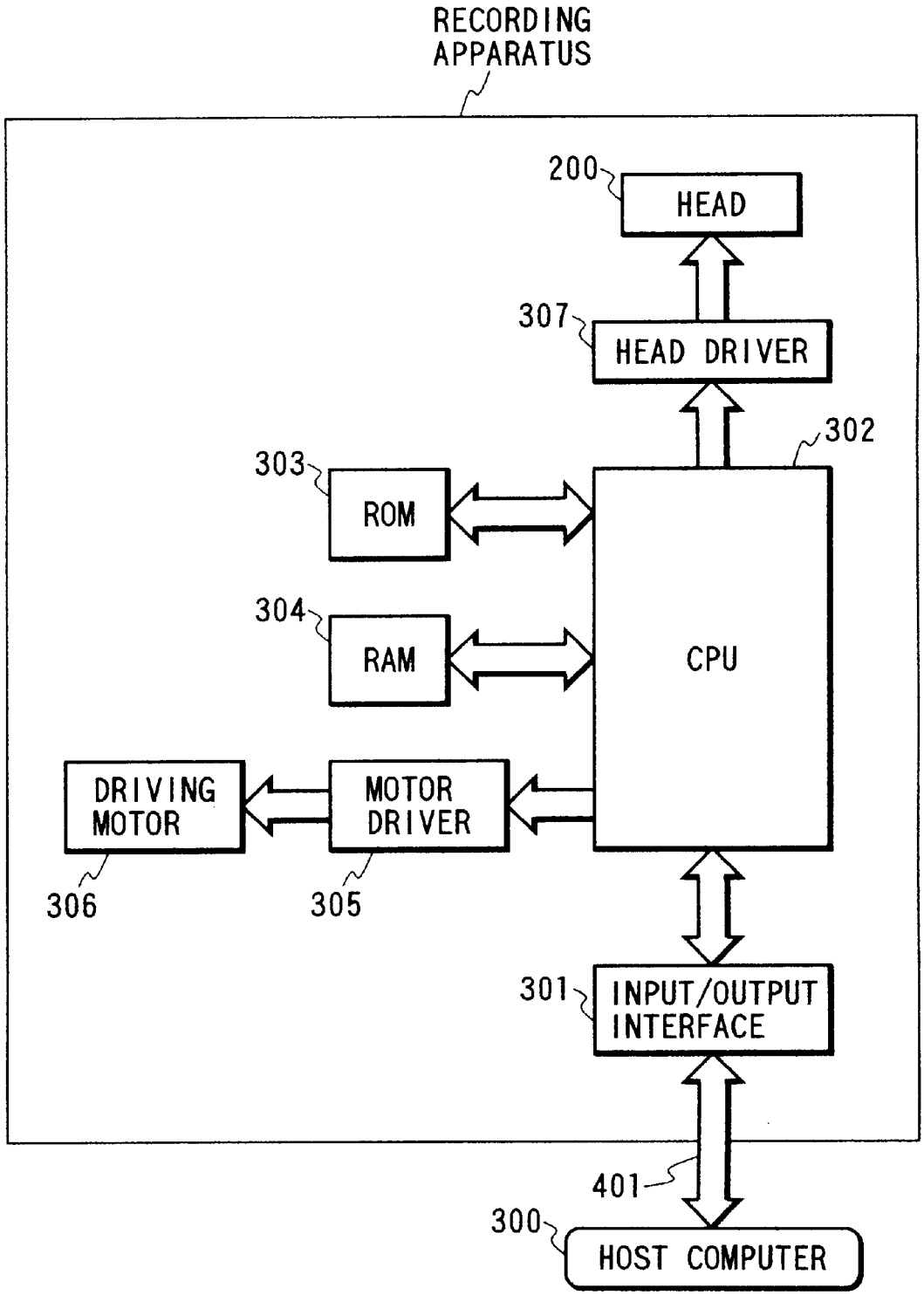
FIG. 16 is a block diagram of the apparatus.

FIG. 16 is a block diagram of an entire apparatus for operating the ink discharge recording to which the liquid discharging method and liquid discharging head of the present invention are applied.

The recording apparatus receives printing information as a control signal from a host computer 300. The printing information is temporarily preserved in an input/output interface 301 in the printing apparatus and at the same time, is converted into data capable of being processed in the recording apparatus, and is inputted to a CPU 302 which serves also as head driving signal supply means. The CPU 302 processes the data inputted thereto by the use of a surrounding unit such as a RAM 304 on the basis of a control program preserved in a ROM 303, and converts the data into data to be printed (image data).

Also, the CPU 102 makes driving data for driving a driving motor for moving the recording paper and the recording head in synchronism with the image data to record the image data at a suitable location on the recording paper. The image data and motor driving data are transmitted to a head 200 and a driving motor 306, respectively, through a head driver 307 and a motor driver 305, and the head and the driving motor are driven at controlled timing to thereby form an image.

As the recording medium which can be applied to the recording apparatus as described above and to which the liquid such as ink is imparted, mention may be made of various kinds of paper, OHP sheet, a plastic material used for compact discs, decoration plates or the like, fabrics, metallic materials such as aluminum and copper, leather materials such as oxhide, pigskin and artificial leather, woods such as trees and plywood, bamboo materials, ceramic materials such as tiles, and three-dimensional structures such as sponges.

Also, the above-described recording apparatus covers a printer apparatus for effecting recording on various kinds of paper, OHP sheets or the like, a recording apparatus for plastics for effecting recording on plastic materials such as compact discs, a recording apparatus for metals for effecting recording on metallic plates, a recording apparatus for leather for effecting recording on leather, a recording apparatus for woods for effecting recording on woods, a recording apparatus for ceramics for effecting recording on ceramic materials, a recording apparatus for effecting recording on three-dimensional net-like structures such as sponges, a textile printing apparatus for effecting recording on fabrics, etc.

As the discharge liquid used in these liquid discharging devices, use can be made of any liquids matching the respective recording mediums or recording conditions.

<Recording System>

Description will now be made of an example of an ink jet recording system using the liquid discharging head of the present invention as a recording head to effect recording on a recording medium.

Figure 17:
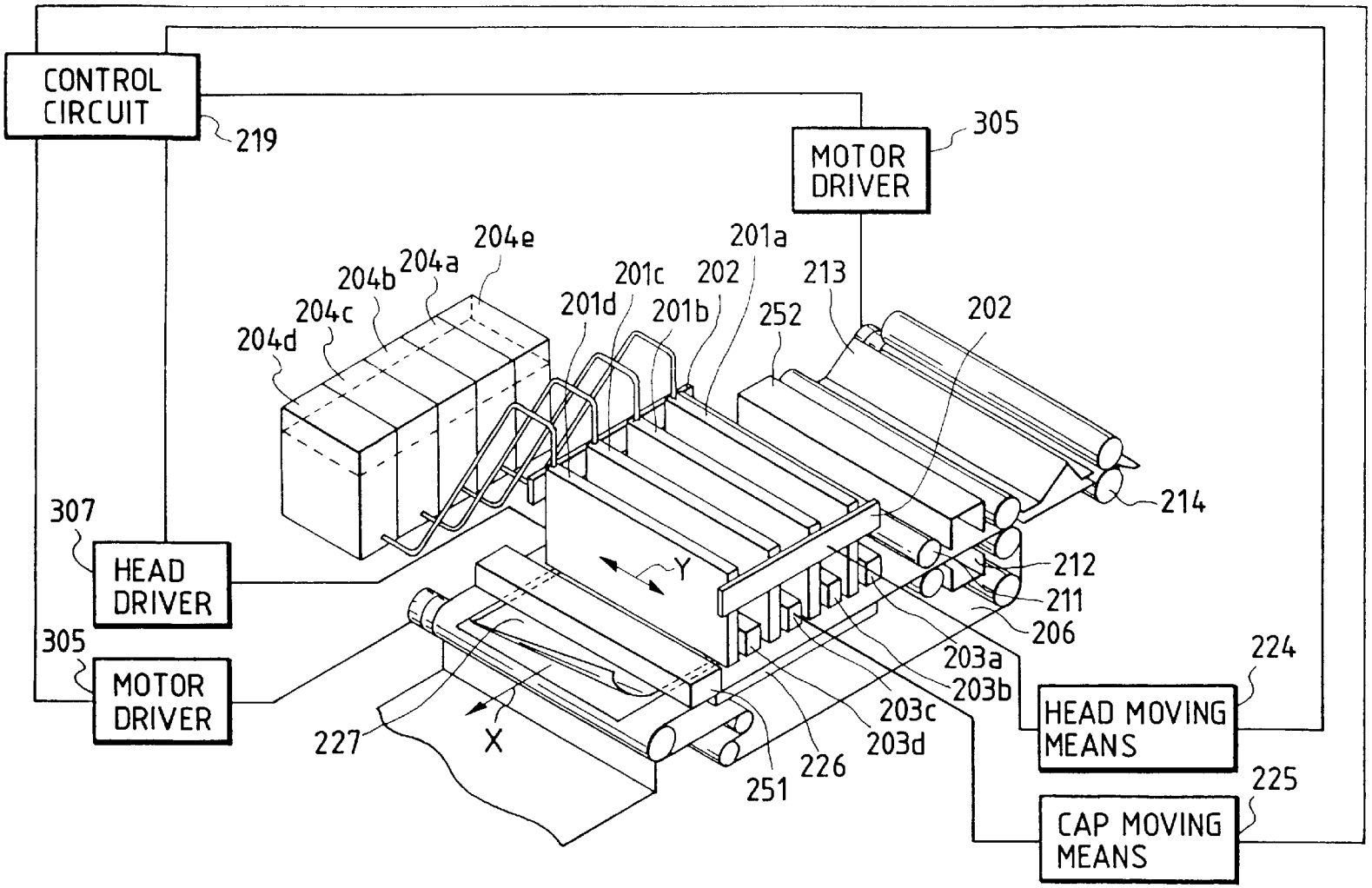
FIG. 17 shows a liquid discharging recording system.
Figure 18A:
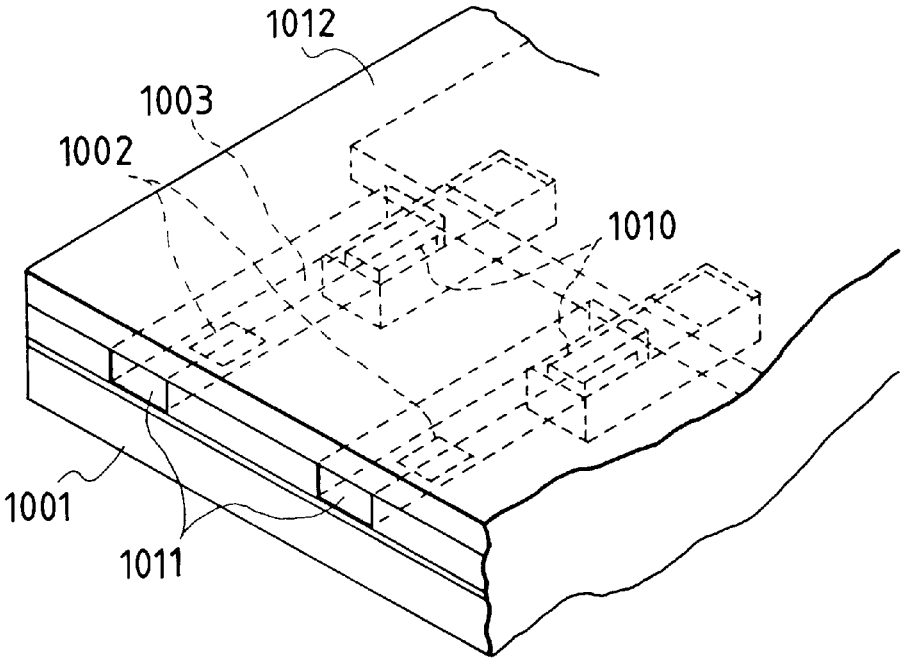
FIGS. 18A and 18B are views for illustrating the liquid flow path structure of a liquid discharging head according to the prior art.
Figure 18B:
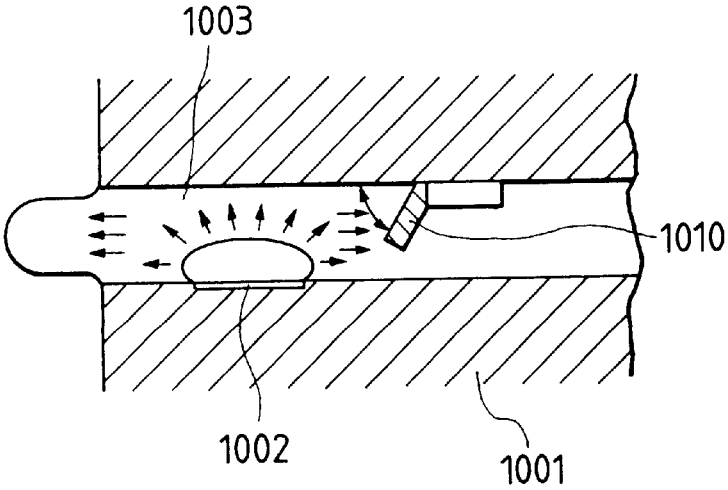

FIG. 17 is a schematic diagram for illustrating the construction of an ink jet recording system using the aforedescribed liquid discharging head 201 of the present invention. The liquid discharging head in the present embodiment is a head of the full line type in which a plurality of discharge ports are disposed at intervals of 360 dpi over a length corresponding to the recordable width of a recording medium 150, and has four heads corresponding to four colors, i.e., yellow (Y), magenta (M), cyan (C) and black (Bk), fixedly supported in parallelism to one another at predetermined intervals in x direction by a holder 202.

A signal is supplied from a head driver 307 constituting driving signal supply means to these heads, and the respective heads are driven on the basis of this signal.

Inks of four colors, i.e., Y, M, C and Bk, as discharge liquids are supplied from ink containers 204*a*–204*d* to the respective heads. The reference character 204*e* designates a bubbling liquid container in which bubbling liquid is contained, and the bubbling liquid may be supplied from this container to each head.

Also, below the respective heads, there are provided head caps 203*a*–203*d* in which are disposed ink absorbing members such as sponges, and during non-recording, these head caps cover the discharge ports of the respective heads, whereby the maintenance of the heads can be accomplished.

The reference numeral 206 denotes a conveyor belt constituting conveying means for conveying any of the various recording mediums as described in each of the previous embodiments. The conveyor belt 206 is passed over a predetermined route by various rollers, and is driven by a driving roller connected to a motor driver 305.

In the ink jet recording system according to the present embodiment, a pre-processing device 251 and a post-processing device 252 for effecting various processes on the recording medium before and after recording is effected are provided upstream and downstream, respectively, of the recording medium conveying route.

The pre-processing and the post-processing differ in their substances from each other in conformity with the kind of the recording medium on which recording is effected and the kind of the ink, but for recording mediums such as metals, plastics and ceramics, the application of ultraviolet rays and ozone thereto is effected as the pre-processing and the surface thereof can be activated to thereby improve the attaching property of the ink. Also, in the case of a recording medium such as plastic which is ready to create static electricity, dust is liable to attach to the surface thereof due to the static electricity and good recording is sometimes hampered by the dust. Therefore, as the pre-processing, the static electricity of the recording medium may preferably be removed by the use of an ionizer device to thereby remove the dust from the recording medium. Also, when a fabric is used as the recording medium, the process of imparting to the fabric a substance selected from among alkaline substances, water-soluble substances, synthetic high molecules, water-soluble metal salt, urea and thiourea can be effected as the pre-processing from the viewpoints of the prevention of oozing and the dyeing capacity. The pre-processing is not restricted thereto, but may be the process of making the temperature of the recording medium appropriate for recording.

On the other hand, the post-processing is to effect heat treatment to a recording medium to which ink has been imparted, fixating treatment for promoting the fixation of the ink by the application of ultraviolet rays, or the treatment of washing a processing agent imparted in the pre-processing and left unreacted.

In the present embodiment, the head has been described as a full line head, whereas this is not restrictive, but use may be made of a form of the compact head as previously described which is conveyed in the widthwise direction of the recording medium to thereby effect recording.

As described above, the present invention can concentrate the growth of an air bubble in the direction toward the free end of a movable member by a simple construction using a movable member, and can further uniformize the growth distribution of the air bubble relative to the discharge port. Thus, according to the present invention, the irregularity of discharged droplets is little and the discharge directionality is uniformized.

By the movable member achieving the various excellent effects as described above being applied to the discharge structure of the atmosphere communication type, it becomes possible to make the discharge efficiency, the refilling efficiency and the stability of discharge which are unavoidable in the discharge structure of the conventional atmosphere communication type compatible, and one or all of the discharge efficiency, the refilling efficiency and the stability of discharge can be improved. Further, the recorded images thereby become very much accurate.

Also, in accordance with the above-described effects, the efficient use of discharge liquid of high viscosity and ready to scorch which could heretofore not be used with the head has become possible and images of high quality could be obtained.

What is claimed is:

1. A liquid discharging head having a liquid discharging port, comprising:

a substrate provided opposite to the liquid discharge port and having a heat generating surface for generating heat creating a bubble in a liquid, the heat generating surface having an end and being opposed to said liquid discharging port; and a movable member interposed between said heat generating surface and said discharge port and having a free end displaceable by said bubble;

wherein at an initial state in which said bubble has not yet been created, said free end of said movable member is not interposed between the end of said heat generating surface and the center of said discharge port.

2. A liquid discharging head according to claim 1, further comprising a wall provided on a side of said free end of said movable member, wherein said wall is a barrier.

3. A liquid discharging head according to claim 2, wherein the surface of at least a portion of the barrier is formed so as to reduce the cross-sectional area of a flow path leading toward the liquid discharge port.

4. A liquid discharging head according to claim 1, characterized in that in order to discharge the air bubble in the liquid after the air bubble has communicated with the atmosphere into the atmosphere, such a degree of air bubble that discharge is not effected is created to thereby displace the movable member.

5. A head cartridge having a liquid discharging head according to claim 1, and a liquid container holding therein the liquid to be supplied to said liquid discharging head.

6. A recording apparatus having a liquid discharging head according to claim 1, and driving signal supply means for supplying a driving signal for discharging the liquid from said liquid discharging head.

7. A recording apparatus having a liquid discharging head according to claim 1, and recording medium conveying means for conveying a recording medium for receiving the liquid discharged from said liquid discharging head.

* * * * *

UNITED STATES PATENT AND TRADEMARK OFFICE

CERTIFICATE OF CORRECTION

PATENT NO. : 6,164,763
DATED : December 26, 2000
INVENTOR(S) : Sadayuki Sugama et al.

It is certified that error appears in the above-identified patent and that said Letters Patent is hereby corrected as shown below:

Title page,
Item [56], References Cited, under FOREIGN PATENT DOCUMENTS, "61-59914" should read -- 55-59914 --.

Column 1,
Line 8, "the step of communicating" should be deleted;
Line 9, "energy with the" should read -- energy, --; and
Line 10, "atmosphere" should be deleted.

Column 6,
Lines 23 and 30, close up right margin;
Lines 24 and 31, close up left margin.

Column 8,
Line 14, "5 $\mu$." should read -- 5 $\mu$m. --.

Column 11,
Line 30, "of" should read -- at --.

Column 12,
Line 32, "directions" should read -- directed --.

Column 18,
Line 41, "port 0" should read -- port O --; and
Line 48, "port 0." should read -- port O. --; and "of" should read -- at --.

Column 19,
Line 8, "travels" should read -- causes to travel --;
Line 10, "$\mu$m-discharge" should read -- $\mu$m discharge --; and "φO" should read -- φO, --;
Line 19, "9A" should read -- 9A) --; and
Line 31, "φ0" should read -- φO --.

Column 20,
Line 23, "ports 0." should read -- ports O. --.

Column 22,
Line 5, "degteriorated" should read -- deteriorated --.

UNITED STATES PATENT AND TRADEMARK OFFICE

CERTIFICATE OF CORRECTION

PATENT NO. : 6,164,763
DATED : December 26, 2000
INVENTOR(S) : Sadayuki Sugama et al.

It is certified that error appears in the above-identified patent and that said Letters Patent is hereby corrected as shown below:

Column 26,
Line 5, "discharge" should read -- discharge, --; and "unavoidable" should be deleted; and
Line 7, "type" should read -- type, --.

Signed and Sealed this

Thirtieth Day of April, 2002

*Attest:*

*Attesting Officer*

JAMES E. ROGAN
*Director of the United States Patent and Trademark Office*